US006170565B1

(12) United States Patent
Nishishita

(10) Patent No.: US 6,170,565 B1
(45) **Date of Patent: *Jan. 9, 2001**

(54) HEAT EXCHANGER

(75) Inventor: Kunihiko Nishishita, Saitama (JP)

(73) Assignee: Zexel Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/117,370

(22) PCT Filed: Dec. 3, 1997

(86) PCT No.: PCT/JP97/04425

§ 371 Date: Jul. 28, 1998

§ 102(e) Date: Jul. 28, 1998

(87) PCT Pub. No.: WO98/25092

PCT Pub. Date: Jun. 11, 1998

(30) Foreign Application Priority Data

Dec. 4, 1996 (JP) ..... 8-324408
Dec. 16, 1996 (JP) ..... 8-335261

(51) Int. Cl.[7] ..... F28F 13/06

(52) U.S. Cl. ..... 165/140; 165/135; 165/146

(58) Field of Search ..... 165/140, 135, 165/146

(56) References Cited

U.S. PATENT DOCUMENTS 5,000,257 * 3/1991 Shinmura ..... 165/140
5,033,540 * 7/1991 Tategami et al. ..... 165/140 X
5,180,004 * 1/1993 Nguyen ..... 165/140

* cited by examiner

*Primary Examiner*—Leonard Leo
(74) *Attorney, Agent, or Firm*—Kanesaka & Takeuchi

(57) ABSTRACT

A heat exchanger comprising tubes (4) for configuring a first heat exchanger (A) and tubes (5) for configuring a second heat exchanger (B), the tubes (4) and (5) being disposed upstream and down stream of a direction that air is flown, fins (6) disposed between the tubes (4), (5), and ends of the respective tubes (4), (5) connected into the respective tanks (2), (3), wherein the fins (6) have louvers (7A), (7B), which are formed into a group of louvers (7A), (7A) formed on the fins disposed in the first heat exchanger (A) and a group of louvers (7B), (7B) formed on the fins disposed in the second heat exchanger (B), these two groups having a different shape of louvers.

3 Claims, 24 Drawing Sheets

HEAT EXCHANGER

TECHNICAL FIELD

The present invention relates to a heat exchanger which is produced by assembling two heat exchangers, which are used differently by disposing them upstream and down stream of a direction that air is flown, so to be formed into a single unit as a whole.

BACKGROUND ART

Conventionally, there is known a heat exchanger, which is made of two heat exchangers, which are used differently. Such a heat exchanger is proposed to have a first heat exchanger, which is configured to have tubes and fins between a pair of tanks, and a second heat exchanger, which is also configured in the same way as the first heat exchanger, both disposed in parallel to each other and integrally connected to each other as described in, for example, Japanese Utility Model Publication No. Hei 6-45155 and Japanese Patent Application Laid-Open Publication No. Hei 7-332890.

Japanese Utility Model Application Laid-Open Publication No. Hei 2-54076 proposes a heat exchanger having a first heat exchanger and a second heat exchanger which are formed into one body, which is configured by stacking flat plate fins, connecting to communicate a plurality of tubes with the plate fins, connecting ends of the tubes to an end plate configuring a tank, and assembling a tank plate to the end plate, wherein the end plate and the tank plate are separately formed or the tank plate is separately formed.

There is also known another heat exchanger, which is produced with two different heat exchangers assembled in series vertically or horizontally. As described in, for example, Japanese Utility Model Publication No. Sho 59-16692 and Japanese Utility Model Application Laid-Open Publication No. Hei 2-36772, there is proposed a heat exchanger which is in a single form structurally but actually has two heat exchangers by disposing tubes and fins between a pair of tanks and a partition plate at the midpoint of the pair of tanks.

Such a heat exchanger has the tanks and tubes to form a heat exchange medium passage and the fins to form an air passage. And, a heat exchange medium supplied from the tank is flown through the plurality of tubes to make heat exchange with the exterior by means of the fins.

The fin is formed to have a corrugated side view with the same pitch by passing a flat fin material through gear-shaped rolls, which are vertically disposed in several sets to shrink the fin material in a longitudinal direction or to compress it. And, in view of improvement of the heat exchange rate and an airflow resistance, the fins are generally formed with louvers on surfaces thereof, and the louvers are formed by the rolls when the fins are formed into the corrugated shape.

In the conventional heat exchanger formed by combining two heat exchangers, the fins disposed between the tubes are often integrally formed and disposed in the first and second heat exchangers. But, the individual heat exchanger has different use, performance and requirements of different heat radiation degrees and airflow resistances. Therefore, where the fins are formed to conform to the performance of one of the heat exchangers, the heat exchange rate of the other heat exchanger is lowered.

Accordingly, the fins connected to the first heat exchanger are separately formed from those connected to the second heat exchanger. But, it is not desirable to form the fins separately for the first and second heat exchangers because the number of parts increases and workability becomes complicated.

In view of the above, the present invention aims to provide a heat exchanger which can have an improved heat exchange performance with the above-described disadvantages remedied without forming the fins separately for the first and second heat exchangers.

SUMMARY OF THE INVENTION

The invention relates to a heat exchanger which comprises tubes for configuring a first heat exchanger and tubes for configuring a second heat exchanger, the tubes being disposed upstream and downstream of a direction that air is flown, fins integrally formed and disposed between both the tubes, and ends of the respective tubes connected into the respective tanks, wherein the fins have louvers, which are formed into a group of louvers formed on the fins disposed in the first heat exchanger and a group of louvers formed on the fins disposed in the second heat exchanger, the two groups having a different shape of louvers.

The invention relates to the heat exchanger above, wherein the two groups of louvers of the fins are formed to have a difference at least in louver angle, slit length, the number of louver members, or width.

The invention relates to the heat exchanger above, wherein the two groups of louvers of the fins have a different opening direction.

The invention relates to the heat exchanger above, wherein the two groups of louvers of the fins are of the same type but opened toward an opposite direction.

The invention relates to the heat exchanger above, wherein the tubes and the fins are integrally assembled and brazed in an oven.

The invention relates to the heat exchanger above, wherein the tubes, the fins and the tanks are integrally assembled and brazed in an oven.

The invention relates to the heat exchanger above, wherein the tubes, the fins and tank segments that are stacked to form the tank are integrally assembled and brazed in an oven.

The invention relates to the heat exchanger above, wherein the tubes, the fins and end plates are brazed in an oven and thereafter connected to the tanks.

The invention relates to the heat exchanger above, wherein the tubes have a U-turn shaped passage.

Therefore, the invention can perform heat exchange without degrading the heat exchange requirements of the respective heat exchangers because the air flowing through the fins is differently flown between the first and second heat exchangers.

For example, when the heat exchanger which is formed to have the radiator and the condenser integrally formed has fins integrally formed between the radiator and the condenser, the fins are determined to have a louver angle, slit length, the number of louver members and width to satisfy the requirements (a heat radiation degree and an air-flow resistance) of the condenser.

Meanwhile, the same fins as above are also formed on the radiator, but since the heat exchange performances required by the radiator and the condenser are different, the radiator often does not satisfy the required performance when the same fins as in the condenser are disposed therein. Therefore, the louvers having a different shape from those disposed in the condenser are formed on the fins disposed in the radiator, so that the requirement of the radiator is fulfilled and the heat exchange performance of the radiator can also be improved.

As described above, where two heat exchangers such as a radiator and a condenser which have difference performances are formed into one heat exchanger body, such heat exchanger has an advantage of improving the heat exchange rate of the individual heat exchangers by disposing fins which are formed to have louvers of a different shape for each fin disposed in the respective heat exchangers, without changing a fin pitch width and the like and with the requirements of performance of the individual heat exchangers fulfilled.

And, since the integrally formed fins are disposed between the respective heat exchangers, assembling property of the tubes is improved. And, the number of parts is reduced, and the production process is made easy. Thus, when the heat exchanger is made of heat exchangers having different performances, a space for installing the heat exchanger is decreased, and the lightweight can be achieved. Therefore, an apparatus having the heat exchanger can be made compact, and the number of steps for installation can also be decreased.

As described above, the present invention has two groups of louvers with different shapes formed on the fins to fulfill the requirements of the individual heat exchangers, resulting in improving the heat exchange rate of the heat exchanger as a whole.

It is preferable to configure the heat exchanger as described in embodiments of this inventions. Specifically, the two groups of louvers on the fins are formed to have a difference at least in louver angle, slit length, the number of louver members or width, and a different louver opening direction. Thus, the requirements for the individual heat exchangers can be fulfilled minutely.

Furthermore, the present invention can be applied to a heat exchanger, which is configured by assembling the tubes and the fins into one body and brazing it in an oven. Basically, the tubes and the fins are integrally assembled and brazed in an oven. In addition to the brazing of the tubes and the fins, any of a tank to be described afterward, tank segments forming the tank and an end plate forming the tank can also be brazed at the same time.

The aforementioned fin structure can also be applied to a heat exchanger, which is formed by integrally assembling the tubes, fins and tanks and brazing them in an oven. In such a case, the tank is formed of a cylindrical body or two split pieces combined into one body and integrally brazed with the tubes and the fins.

And, the present invention can also be applied to a heat exchanger, which is formed by integrally assembling the tubes, the fins and the tank segments stacked for forming the tank and brazing them in an oven. In this case, the above-described laminate type having the tank segments integrally formed with the tubes is integrally brazed.

The fin structure of this invention can also be applied to a heat exchanger, which is produced by brazing tubes, fins and end plates in an oven, and thereafter bonded with tanks. In this case, after brazing the tubes, the fins and the end plates in the oven, a sealing material is used to bond with tanks by caulking or the like. This heat exchanger is not required to have a very high-pressure resistance.

The present invention can also be applied to a heat exchanger, which is formed with a U-turn shape passage formed in the tubes. Such a heat exchanger is a single-tank type, which is formed by bonding the ends of the tubes located on the other side of the U-shaped passage with the tank. The invention can also be applied to this single tank type heat exchanger.

BEST MODE FOR CARRYING OUT THE INVENTION

An embodiment of the invention will be described with reference to the drawings.

Figure 1:
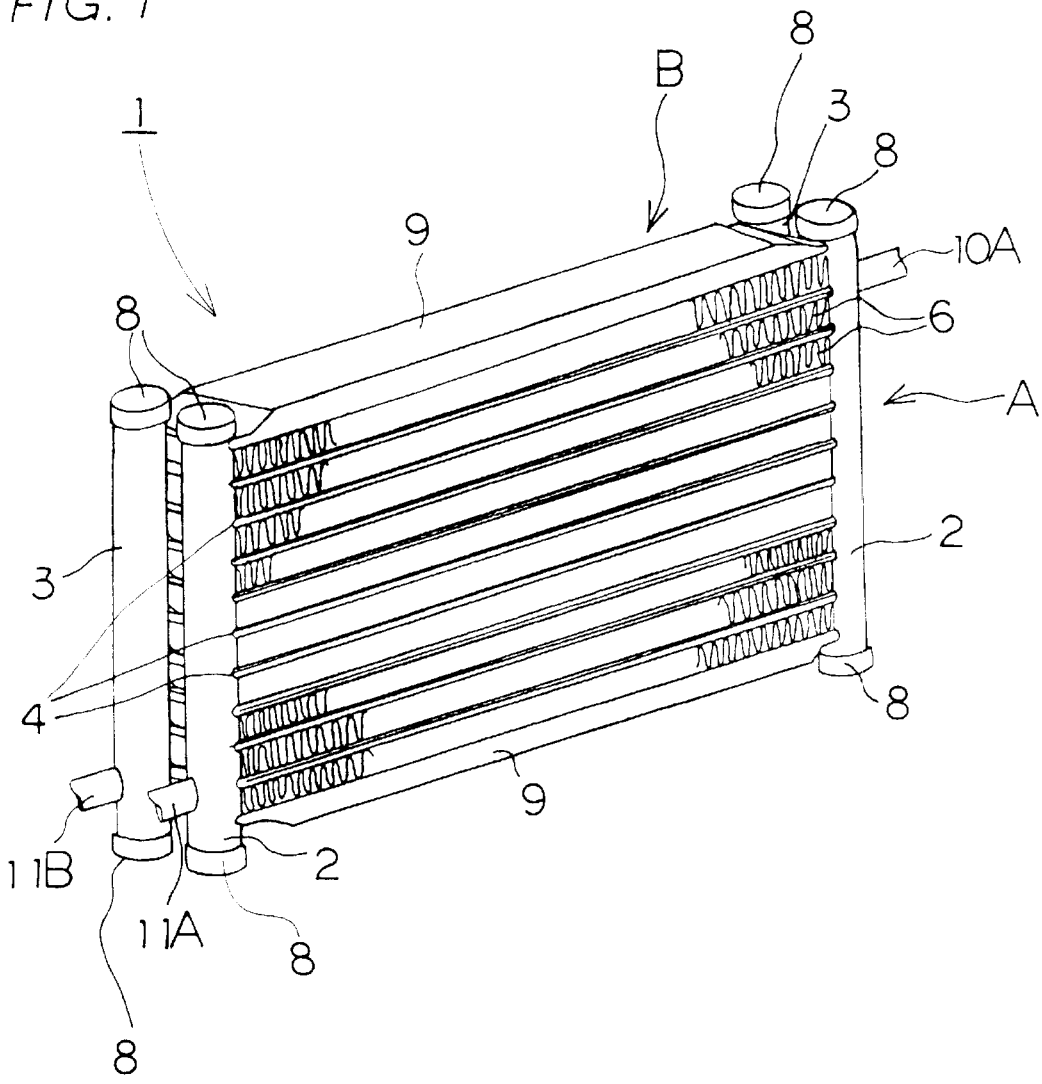
FIG. 1 is a perspective view of the heat exchanger according to the embodiment of the invention.
Figure 2:
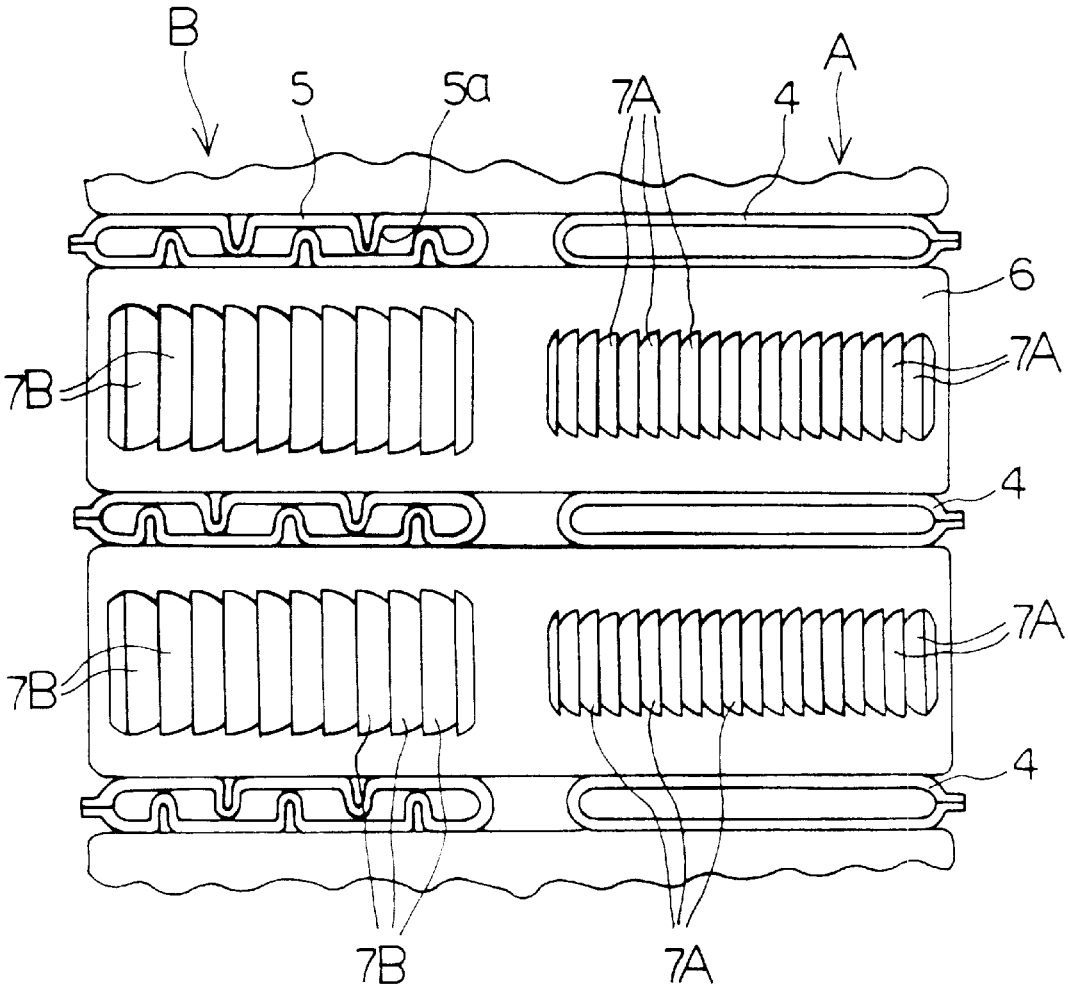
FIG. 2 is a vertical sectional view in part of the fins and tubes of FIG. 1 according to an embodiment of the invention.

FIG. 1 is a perspective view of the heat exchanger of this embodiment. FIG. 2 shows partly tubes and fins used in the heat exchanger. In the drawings, the heat exchanger 1 has two pairs of tanks 2, 2 and 3, 3 disposed in parallel, a plurality of tubes 4, 4 disposed between one pair of tanks 2, 2, a plurality of tubes 5, 5 disposed between the other pair of tanks 3, 3, same fins 6, 6 are disposed to be stacked between the tubes 4, 4 and 5, 5 in such manner or to extend between the tubes 4, 5, and the tubes 4, 4 and 5, 5 and the fins 6, 6 are brazed into one body in an oven. Both ends of the tubes 4, 5 are connected into tube insertion holes (not shown) of the tanks 2, 2 and 3, 3.

Top and bottom end openings of the tanks 2, 3 are sealed by a cap 8, side plate connection holes (not shown) are formed at the top and bottom ends of the tanks 2, 3, and both ends of side plates 9, 9 are connected into these side plate connection holes. Specifically, the side plates 9 are connected to the top and bottom ends of the four tanks 2, 2 and 3, 3, and first and second heat exchangers A, B which are disposed in parallel in a transverse direction are formed into one body.

Partition plates (not shown) are disposed within the tank 2 to divide the interior of the tank 2 in a longitudinal direction. Inlet joints 10A, 10B are connected to the tanks 2, 3 on one side of the two pairs of tanks 2, 2 and 3, 3, and outlet joints 11A, 11B are connected to the tanks 2, 3 on the other side. And, a heat exchange medium is flown to meander a plurality of times between the inlet joints 10A, 10B and the outlet joints 11A, 11B. And, long beads 5*a* are formed in the tube 5 and contacted with the plate surface or another long bead 5*a*, thereby improving a pressure resistance and a heat exchange rate by causing turbulence in the flowing heat exchange medium.

In this embodiment, the tubes 4, 5 are an electric-resistance welded pipe, extrusion molded, two pressed or rolled and combined plates, a single pressed or rolled plate which is further folded into a halves, or a single plate which is folded into halves while rolling. And, a tube material is an extrusion material, a three-layered material with both surfaces clad or a four-layered material with both surfaces clad and having an intermediate layer.

Figure 3:
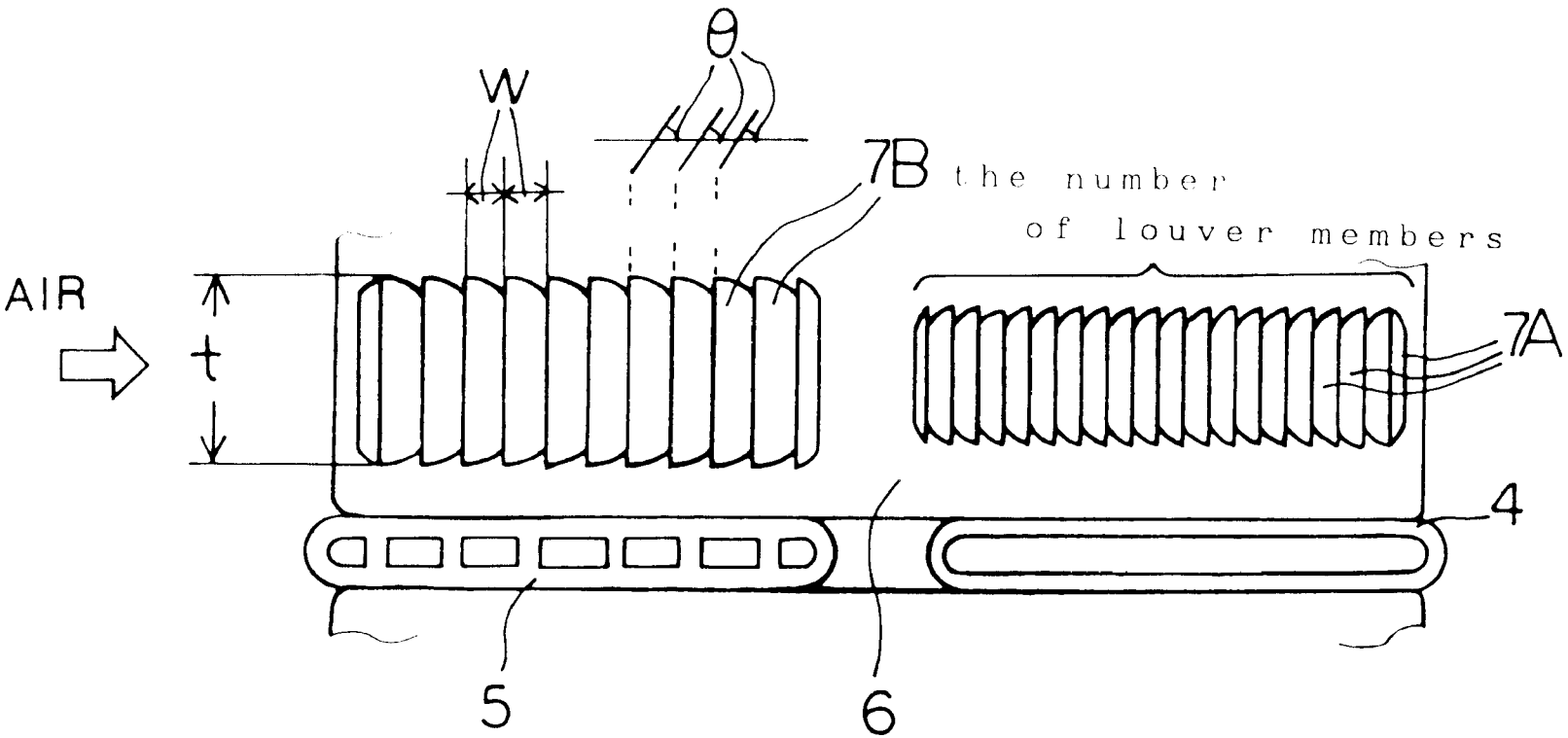
FIG. 3 is a vertical sectional view in part of a fin and a tube for illustrating the opening direction and angle, slit length and width of the louver.

In FIG. 2, the fin 6 has a different group of louvers on a flat portion of the fin 6 connected to the tubes 4 configuring the first heat exchanger A and on a flat portion of the fin 6 connected to the tubes 5 configuring the second heat exchanger B. In this embodiment, one group of louvers has a different opening direction, slit length, width, louver angle and the number of louver members from the other group of louvers. Specifically, as shown in FIG. 3, louvers 7A, 7B are formed to have a different opening direction, slit length t, width w, louver angle θ and the number of louver members. These louvers 7A, 7B are formed on the flat portion of the fin 6 at the same time when the fin 6 is formed into a corrugated shape.

In this embodiment, the first heat exchanger A is a radiator and the second heat exchanger B is a condenser, which are disposed in parallel in a transverse direction to form the heat exchanger 1.

As described above, by changing the opening shapes of the louver formed on the flat portion of the fin 6 between the first heat exchanger A and the second heat exchanger B, the flowing air can be caused to have turbulence or dispersion to improve the heat exchange. And, the heat exchange requirements of the individual heat exchangers can be fulfilled, respectively. Since the integrally formed fins can be used to improve the respective heat exchange rates and to integrally form a plurality of heat exchangers into one body, the number of parts can be decreased, and the production process can be facilitated. Besides, since the plurality of heat exchangers can be made into one body, a space for its installation is decreased, and it can be made light weighted. An apparatus having the heat exchanger can be made compact, and the number of steps for installation can also be decreased.

Preferred embodiments of the invention will be described with reference to the drawings. It is to be understood that like reference numerals are given to like components through the drawings.

Figure 4:
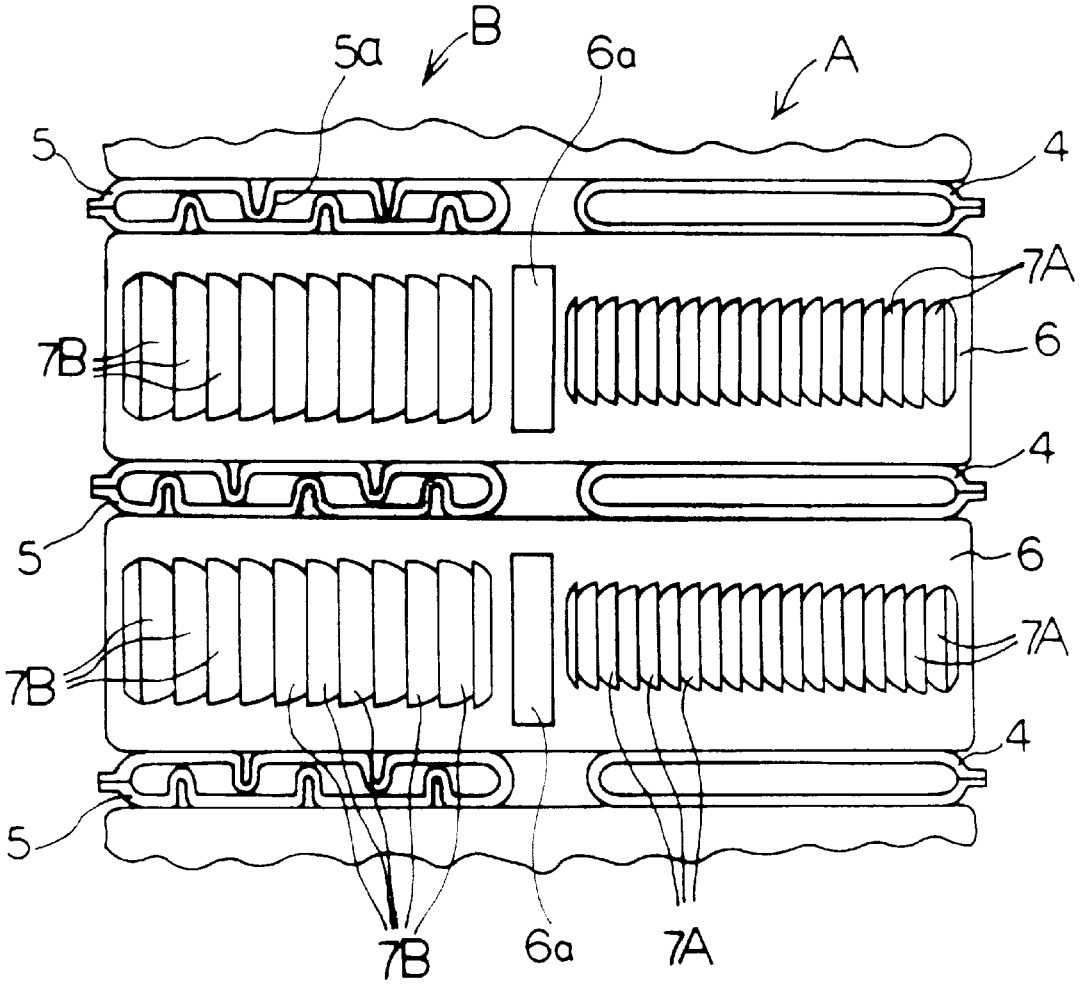
FIG. 4 is a vertical sectional view in part of fins and tubes according to another embodiment of the invention.

FIG. 4 shows another embodiment of the fins, which have slits 6*a* for preventing heat conduction formed on the fins shown in FIG. 2. By forming the slits 6*a* on the fins 6, the aforementioned effect of the fins enabling to meet the heat exchange requirements of the individual heat exchangers can be materialized more specifically.

Figure 5:
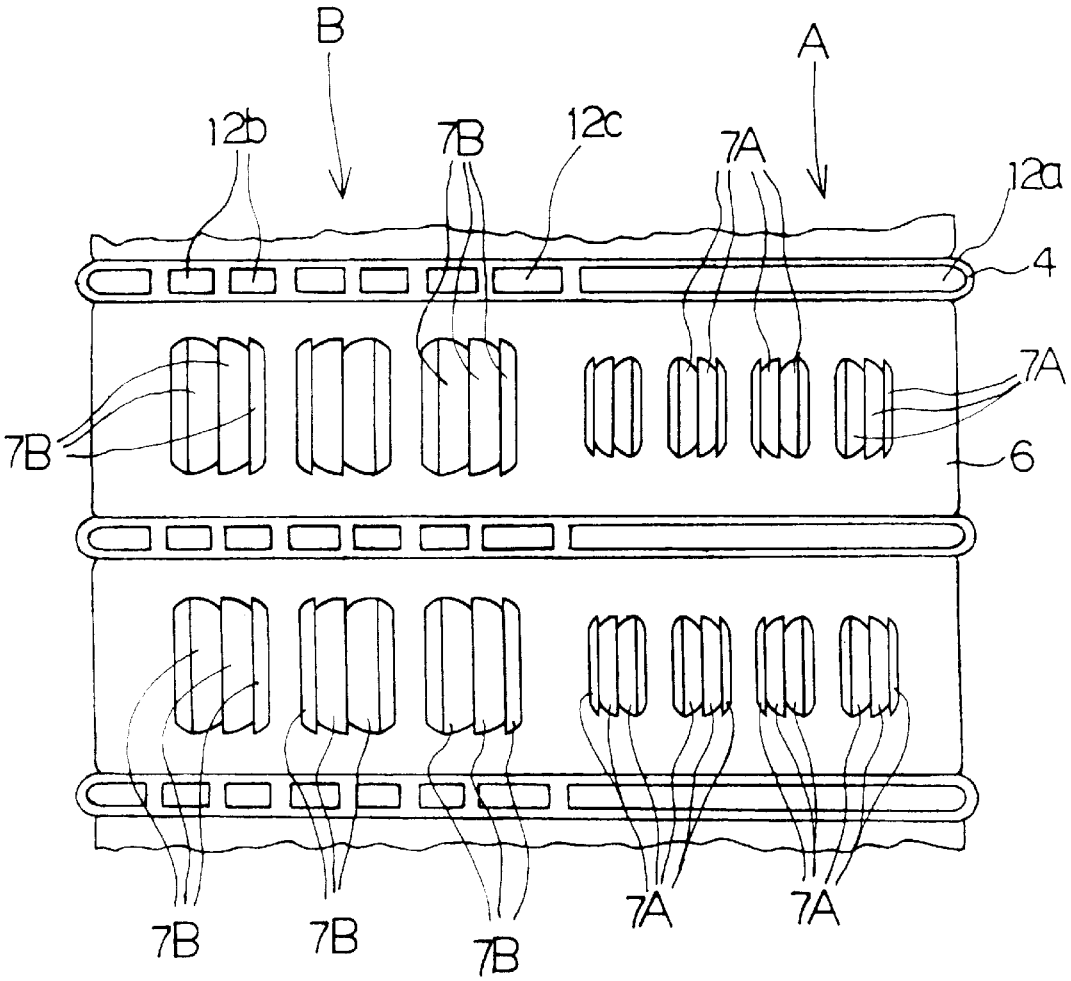
FIG. 5 is a vertical sectional view in part of fins and tubes according to another embodiment of the invention.
Figure 6:
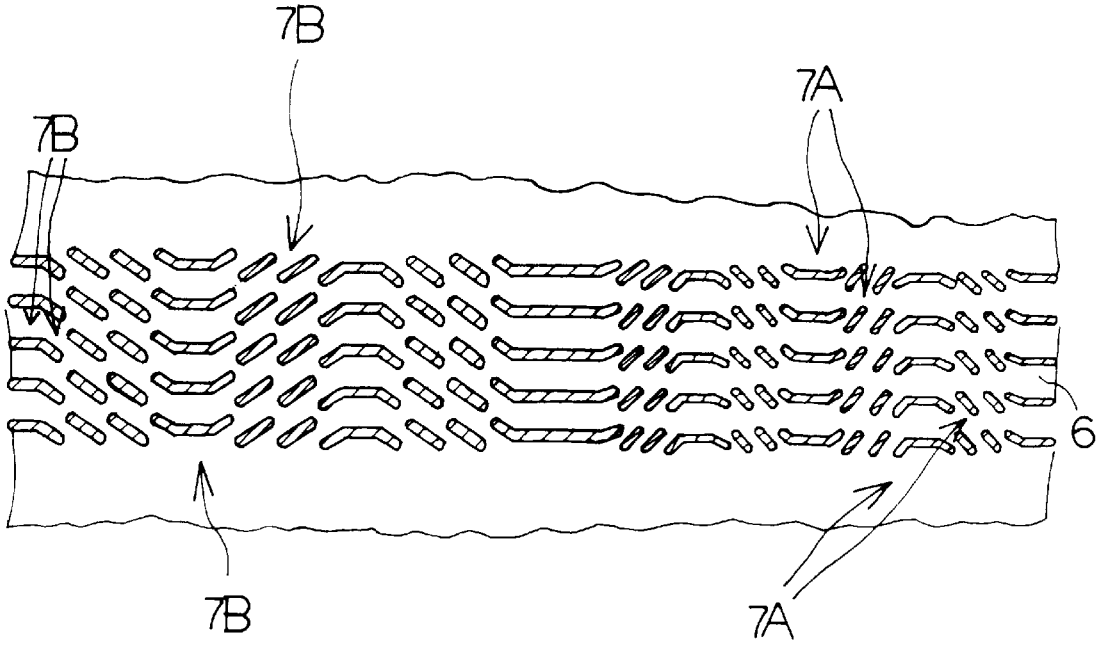
FIG. 6 is a transverse sectional view of the fins shown in FIG. 5.

FIG. 5 and FIG. 6 relate to another embodiment of fins, wherein FIG. 5 is a vertical sectional view in part of fins and tubes and FIG. 6 is a transverse sectional view in part of a fin.

In FIG. 5 and FIG. 6, the fins 6, which are disposed in the first and second heat exchangers A, B, have the louvers 7A, 7B with a different shape formed on the flat portion thereof depending on the respective heat exchangers. These louvers 7A, 7B are formed to have a given pattern, and the louvers 7A, 7B are formed to have a different shape. According to this embodiment, the louvers form a single specific pattern on the fins 6 connected to the first heat exchanger A, and this pattern is repeated to form the louvers 7A. Meanwhile, three louvers form a single specific pattern on the fins 6 connected to the second heat exchanger B, and the pattern is repeated to form the louvers 7B. These louvers are formed with their openings directed as required depending on the respective louver patterns. In the heat exchanger of this embodiment, the tubes 4 for configuring the first and second heat exchangers A, B are extrusion-molded into one body, 12*a* denotes tube passages to form the first heat exchanger A, and 12*b* denotes tube passages to form the second heat exchanger B. A portion positioned between the first and second heat exchangers A, B has a hollow portion 12*c* formed to prevent heat from being conducted between the first and second heat exchangers A, B.

Thus, the louvers are formed with a louver angle as well as a slit length, a width and quantity changed for each louver pattern, or since the flowing air is caused to make turbulence or dispersed by changing the direction of the louver's opening, the heat exchange performance of the heat exchanger can be improved.

Figure 7:
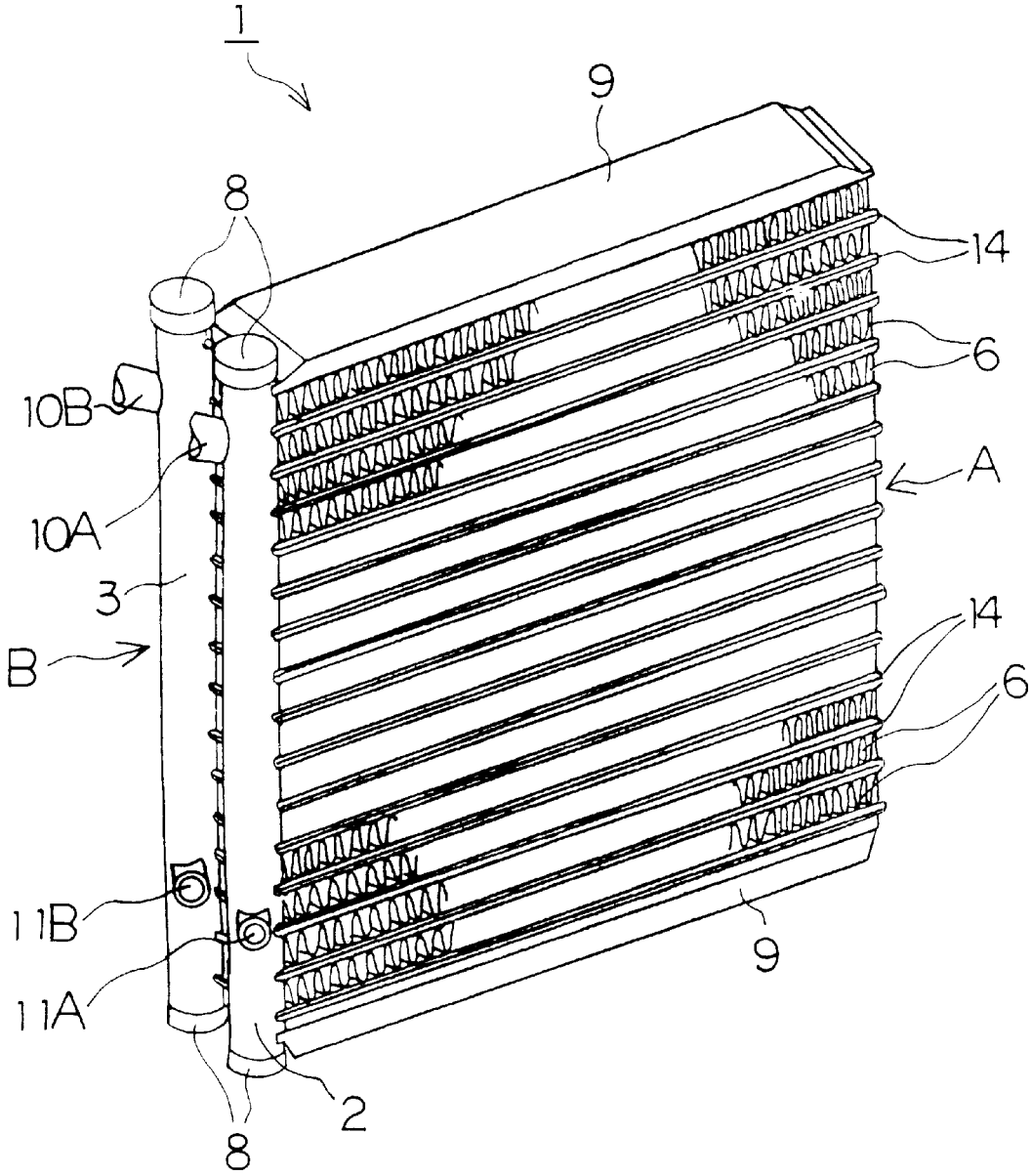
FIG. 7 is a perspective view of the heat exchanger according to another embodiment of the invention.
Figure 8:
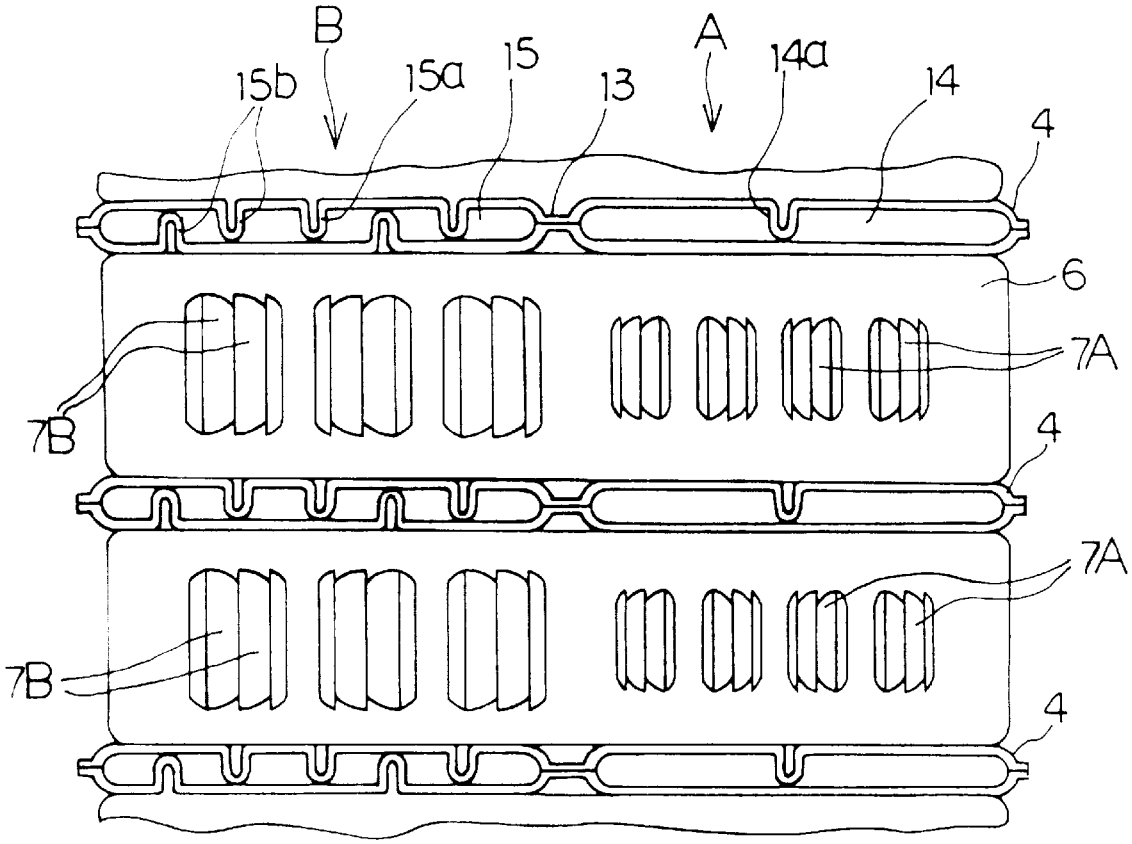
FIG. 8 is a vertical sectional view in part of fins and tubes according to another embodiment of the invention.
Figure 9:
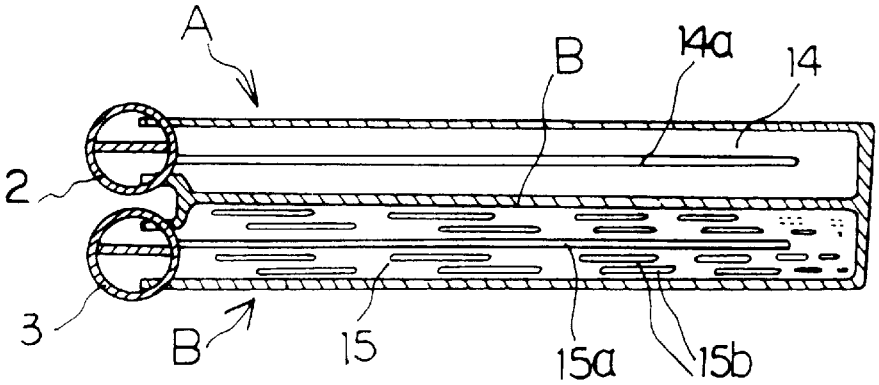
FIG. 9 is a transverse sectional view of the tube having a U-shaped passage according to another embodiment of the invention.

FIG. 7 shows a heat exchanger, which is configured by combining first and second single-tank type heat exchangers. FIG. 8 and FIG. 9 show sectional views in part of tubes and fins of the heat exchanger shown in FIG. 7.

In the drawings, one end of each tube 4 is connected to the tanks 2, 3, the respective tubes 4, 4 have a closed part 13 in a longitudinal direction thereof to divide the passage into two in the longitudinal direction. One passage 14 is connected to the tank 2 to form the first heat exchanger A, and other passage 15 is connected to the tank 3 to form the second heat exchanger B. Thus, the first and second heat exchangers A, B are integrally formed into one body.

Reference numerals 14*a*, 15*b* are ridges, which are in contact with the plate surface, or the ridges 14*a*, 14*a* or 15*a*, 15*a* are mutually contacted to form the respective passages 14, 15 into the U-turn shape. Reference numerals 15*b*, 15*b* are long beads.

Fins 6 disposed in the first and second heat exchangers A, B have louvers 7A, 7B with a different shape formed on a portion to be connected to the first heat exchanger A and a portion to be connected to the second heat exchanger B, and the respective louvers 7A, 7B are formed to have an individual particular pattern, and the respective patterns are formed into an alternately different opening direction. Therefore, air is dispersed and caused to have turbulence, thereby improving the heat exchange performance of the respective heat exchangers.

Figure 10:
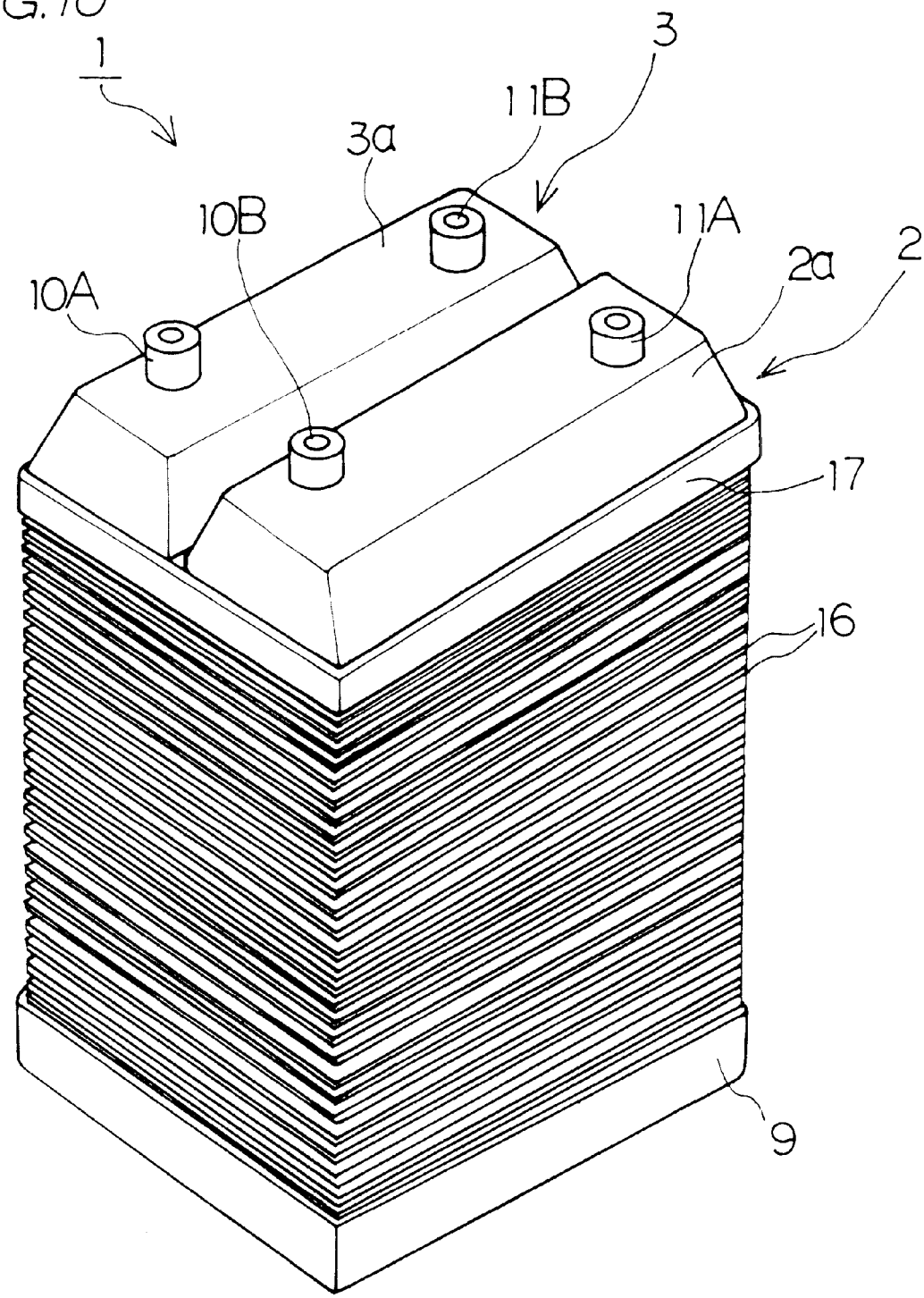
FIG. 10 is a perspective view of the heat exchanger according to another embodiment.
Figure 11:
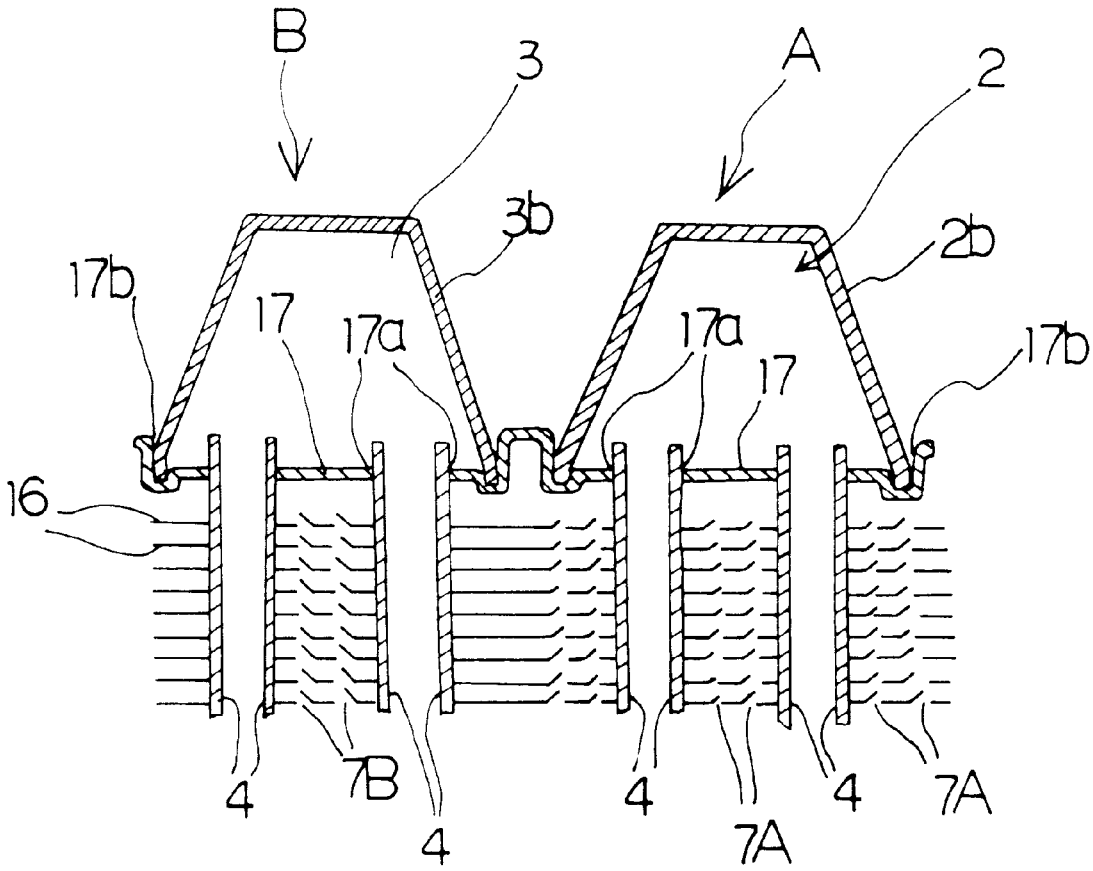
FIG. 11 is a vertical sectional view of tanks in the heat exchanger shown in FIG. 10.

The embodiment shown in FIG. 10 is a heat exchanger with the first and second heat exchangers A, B formed into one body by using plate-type fins 16 stacked. To configure this heat exchanger, tube insertion holes 16*a* are formed through the plate fins 16 (see FIG. 12), a plurality of circular tubes 4, 4 are inserted into the tube insertion holes 16*a*, at least one end of each tube 4 is in contact with a tube insertion hole 17*a* of an end plate 17 as shown in FIG. 11, and a tank plate 2*b* configuring the first heat exchanger A and a tank plate 3*b* configuring the second heat exchanger B are engaged with two rectangular mating grooves 17*b* surrounding the plurality of tubes 4, 4 formed on the end plate. Thus, the first and second heat exchangers A, B are configured into one body. Specifically, the tanks 2, 3 are formed of the end plate 17 and the tank plates 2*b*, 3*b*. And, after brazing the tubes 4, 4, the fins 16, 16 and the end plate 17, the tank plates 2*b*, 3*b* are mounted and joined by caulking with a sealing material (not shown). The inlet joints 10A, 10B and outlet joints 11A, 11B are formed on the tank plates 2*b*, 3*b*, and the side plate 9 is disposed on the opposite side from the tanks 2, 3.

Figure 12:
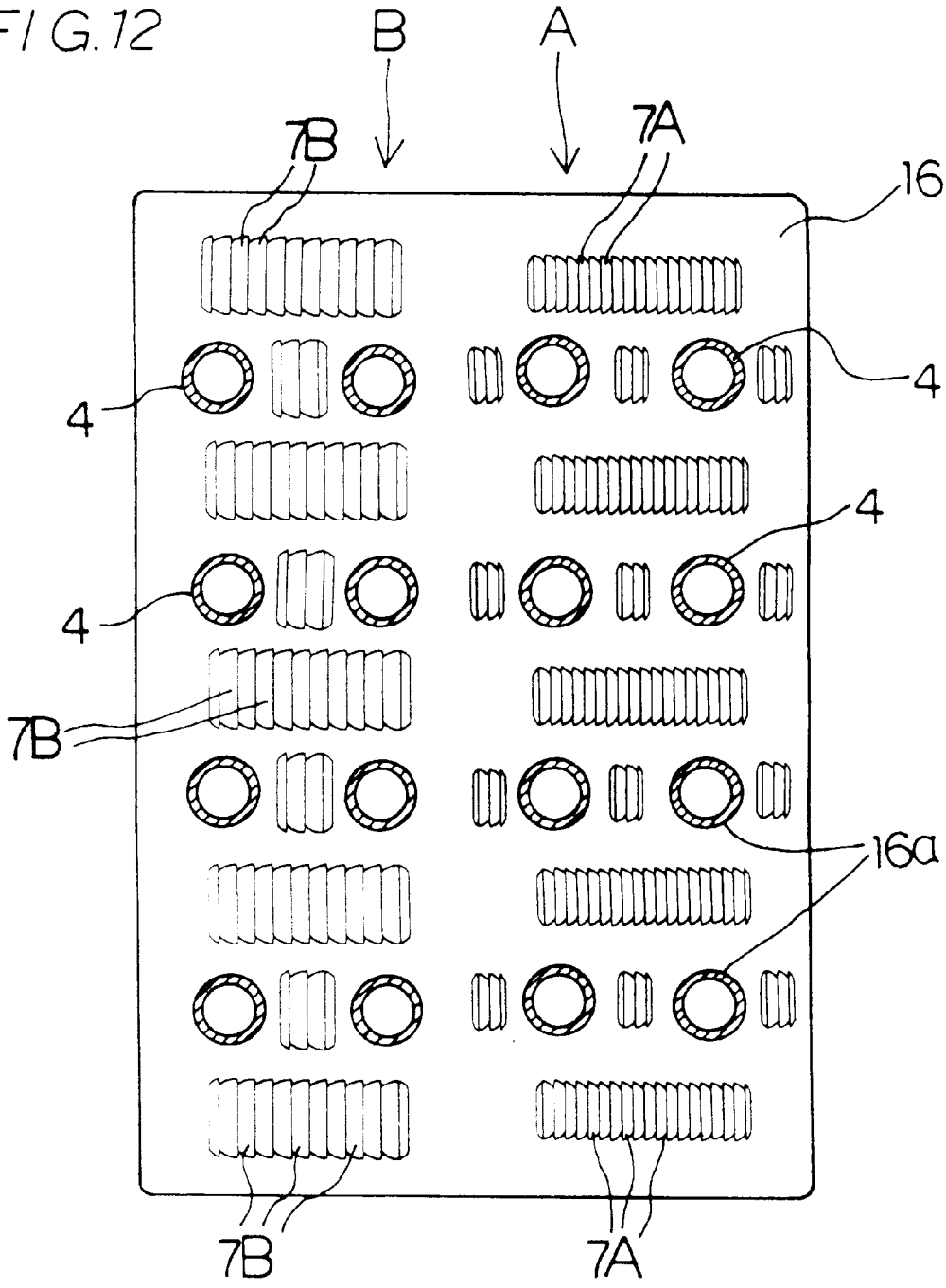
FIG. 12 is a vertical sectional view of fins and tubes of the heat exchanger shown in FIG. 10.

FIG. 12 shows a plate fin used to form the heat exchanger shown in FIG. 10. This plate fin 16 has the louvers 7A, 7B formed around the tube insertion holes 16*a*. The louvers 7A, 7B are formed to have a predetermined pattern. The louvers 7A formed on a portion for configuring the first heat exchanger A and the louvers 7B formed on a portion for configuring the second heat exchanger B are formed to have a different louver angle, slit length, width and the number of louver members, or a different louver opening direction for each louver pattern. Therefore, air flowing through the plate fins 16 is dispersed and caused to make turbulence to effectively improve the heat exchange performance.

Figure 13:
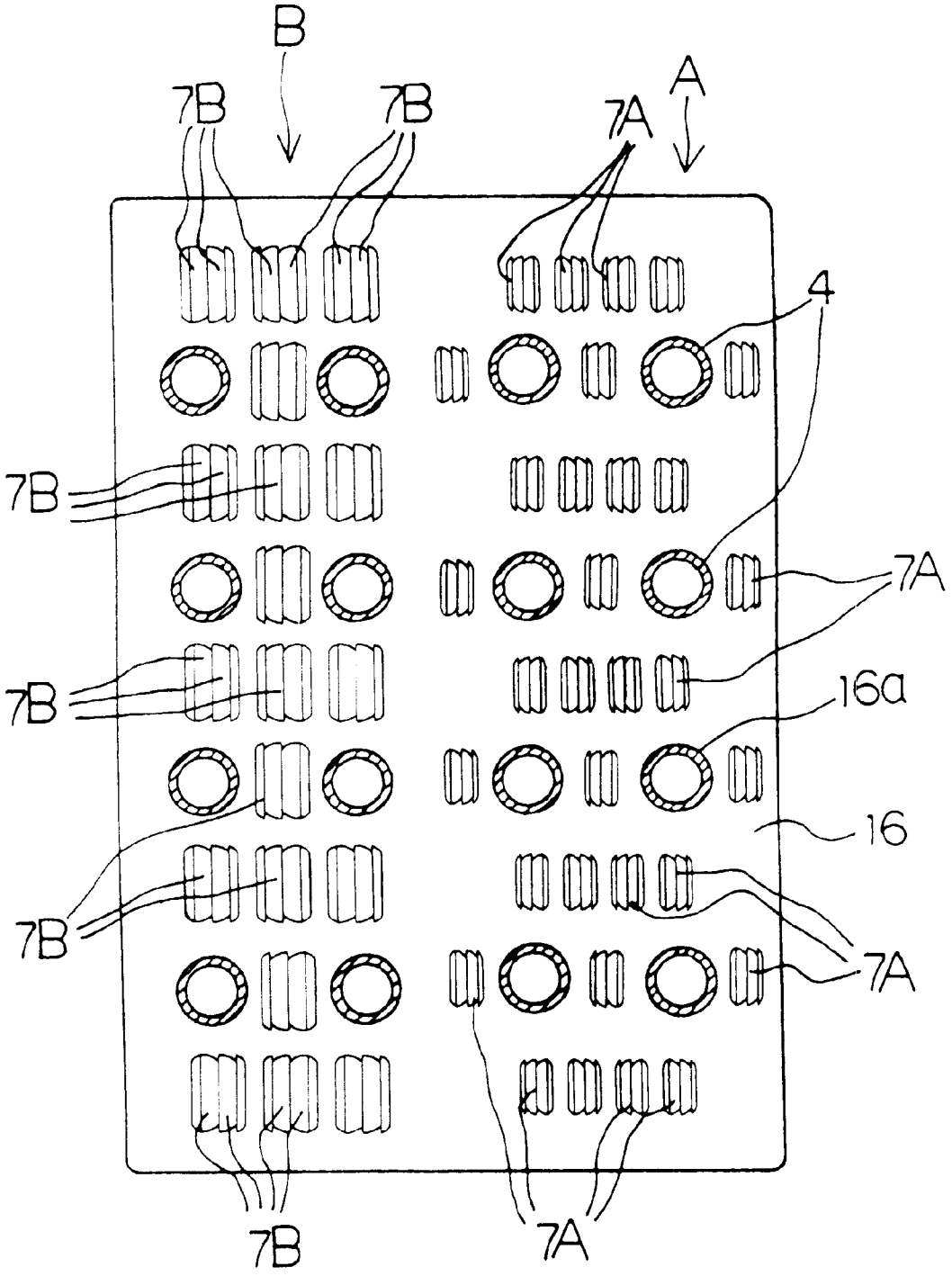
FIG. 13 is a vertical sectional view showing another embodiment of the plate fin.

FIG. 13 shows another example of plate fin. This plate fin 16 has the louvers 7A, 7B formed around the tube insertion holes 16*a*. The louvers 7A, 7B are formed to have a predetermined and plurality of patterns. The louvers 7A formed on a portion for configuring the first heat exchanger A and the louvers 7B formed on a portion for configuring the second heat exchanger B are formed to have a different louver angle, slit length, width and the number of louver members, or a different louver opening direction for each louver pattern. Therefore, air flowing through the plate fins 16 is dispersed and caused in the same way as described above to make turbulence to effectively improve the heat exchange performance.

A laminate type integral heat exchanger having the tank formed into one body with the tubes and a heat exchanger having a two-split type tank can also have louvers with a variable opening shape to improve the heat exchange performance.

As described above, the heat exchangers of the embodiments described above have the two groups of louvers formed to have a different pattern on the fins, so that the required performances of the respective heat exchangers can be fulfilled, and the heat exchange rate as a whole can be also improved.

And, when the two groups of louvers are formed on the fin to have a difference at least in louver angle, slit length, width and the number of louver members, or a different louver opening direction, the performances required by respective heat exchangers can be fulfilled minutely.

Furthermore, the described embodiments can be applied to a heat exchanger, which is configured by assembling the tubes and the fins into one body and brazing it in an oven. Basically, the tubes and the fins are integrally assembled and brazed in an oven. In addition to the brazing of the tubes and the fins, any member of a tank to be described afterward, tank segments forming the tank and an end plate forming the tank can also be brazed at the same time.

The aforementioned fin structure can be also applied to a heat exchanger, which is formed by integrally assembling the tubes, fins and tanks and brazing them in an oven. In such a case, the tank is formed of a cylindrical body or two split pieces combined into one body and integrally brazed with the tubes and the fins.

And, the above-described can also be applied to a heat exchanger, which is formed by integrally assembling tubes, fins and tank segments stacked for forming the tank and brazing them in an oven. In this case, the above-described laminate type having the tank segments integrally formed with the tubes is integrally brazed.

The fin structure of this embodiment can be also applied to a heat exchanger, which is produced by brazing tubes, fins and end plates in an oven, and thereafter bonded with tanks. In this case, after brazing the tubes, the fins and the end plates in the oven, a sealing material is used to bond with the tank by caulking or the like. This heat exchanger is not required to have a very high-pressure resistance.

The above-described embodiment can be also be also applied to a heat exchanger, which is formed with a U-turn shape passage formed in the tubes. Such a heat exchanger is a single-tank type, which is produced by bonding the ends of the tubes on the other side of the U-shaped passage with the tank. The fin structure of this embodiment can be also applied to this single tank type.

Figure 14:
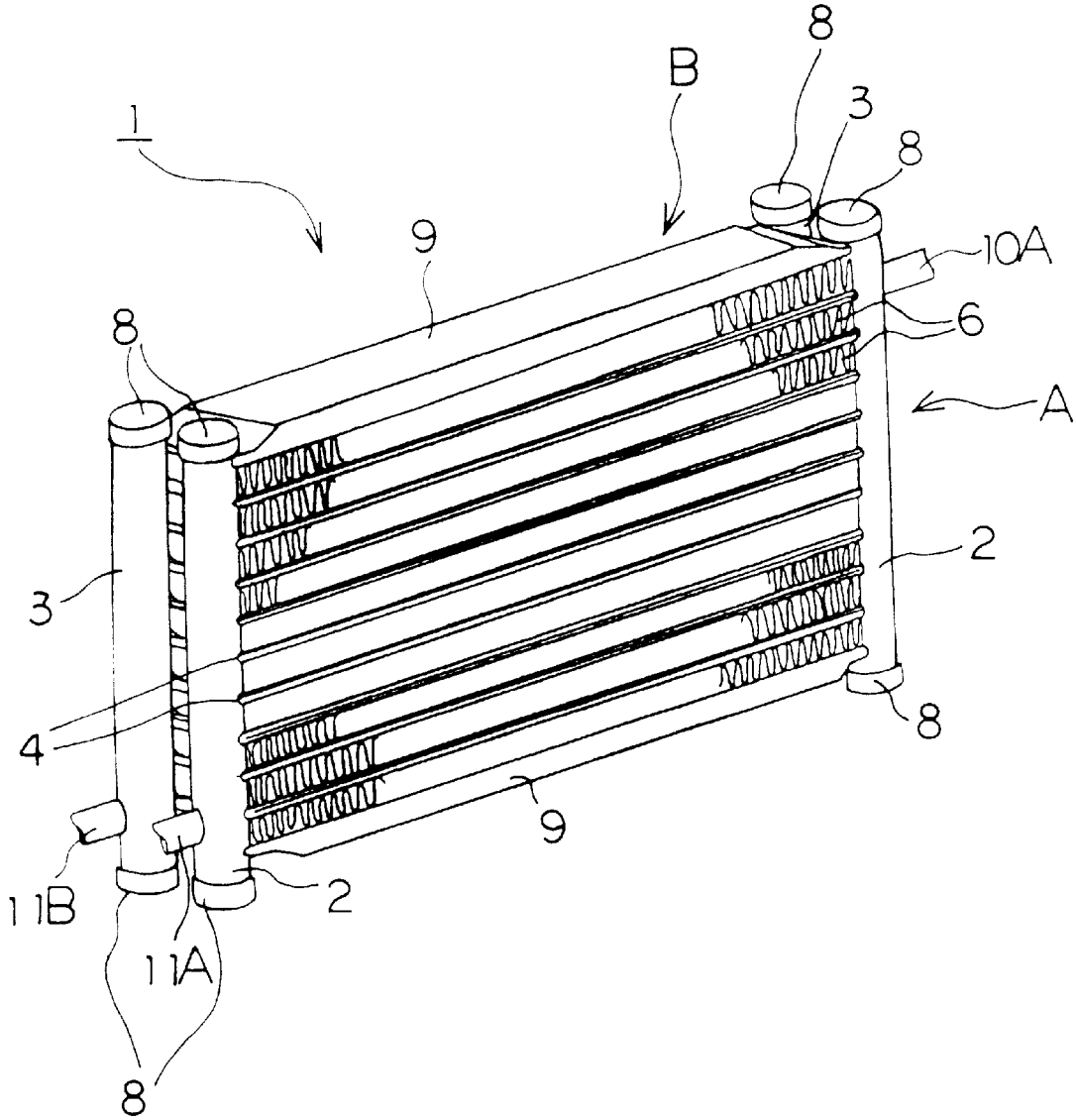
FIG. 14 is a perspective view of the heat exchanger according to another embodiment of the invention.
Figure 15:
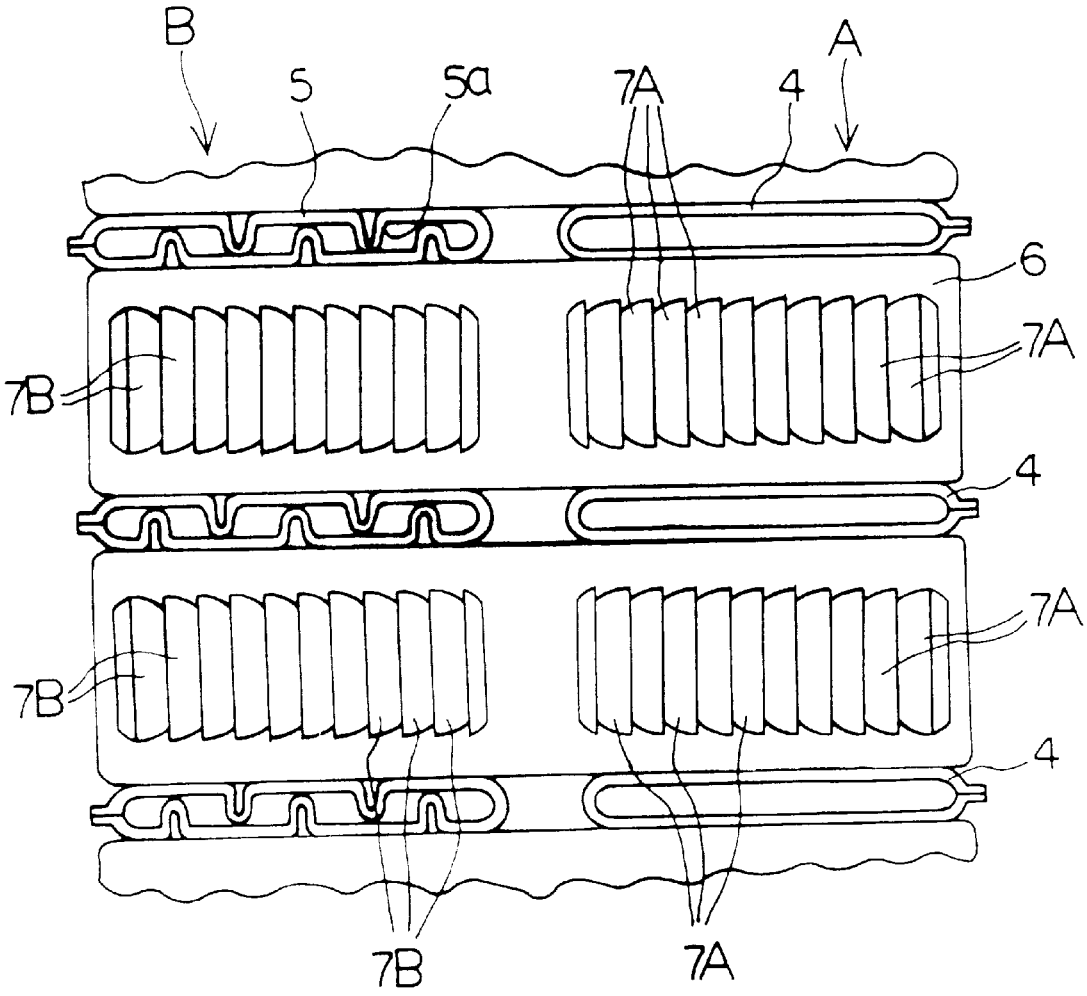
FIG. 15 is a vertical sectional view in part of the fins and tubes shown in FIG. 14.

FIG. 14 is a perspective view of the heat exchanger of another embodiment, and FIG. 15 shows tubes and fins in part used for the heat exchanger of FIG. 14. The heat exchanger 1 of this embodiment has, in the same way as the above-described embodiment, two pairs of tanks 2, 2 and 3, 3 disposed in parallel, a plurality of tubes 4, 4 disposed between one pair of tanks 2, 2, a plurality of tubes 5, 5 disposed between the other pair of tanks 3, 3, same fins 6, 6 disposed to be stacked between the tubes 4, 4 and 5, 5 in such manner as to extend between the tubes 4, 5, and the tubes 4, 4 and 5, 5 and the fins 6, 6 are brazed into one body in an oven. Both ends of the tubes 4, 5 are connected into tube insertion holes (not shown) of the tanks 2, 2 and 3, 3.

Top and bottom end openings of the tanks 2, 3 are sealed with a cap 8, side plate connection holes (not shown) are formed at the top and bottom ends of the tanks 2, 3, and both ends of side plates 9, 9 are connected into these side plate connection holes. Specifically, the side plates 9 are connected to the top and bottom ends of the four tanks 2, 2 and 3, 3, and first and second heat exchangers A, B which are disposed in parallel in a transverse direction are formed into one body.

Partition plates (not shown) are disposed within the tank 2 to divide the interior of the tank 2 in a longitudinal direction. Inlet joints 10A, 10B are connected to the tanks 2, 3 on one side of the two pairs of tanks 2, 2 and 3, 3, and outlet joints 11A, 11B are connected to the tanks 2, 3 on the other side. And, a heat exchange medium is flown to meander a plurality of times between the inlet joints 10A, 10B and the outlet joints 11A, 11B. And, long beads 5*a* are formed in the tube 5 and contacted with the plate surface or another long bead 5*a*, thereby improving a pressure resistance and a heat exchange rate by causing turbulence in the flowing heat exchange medium.

In this embodiment, the tubes 4, 5 are an electric-resistance welded pipe, extrusion molded, two pressed or rolled and combined plates, a single pressed or rolled plate which is further folded into halves, or a single plate which is folded into halves while rolling. And, a tube material is an extrusion material, a three-layered material with both surfaces clad or a four-layered material with both surfaces clad and having an intermediate layer.

Figure 16:
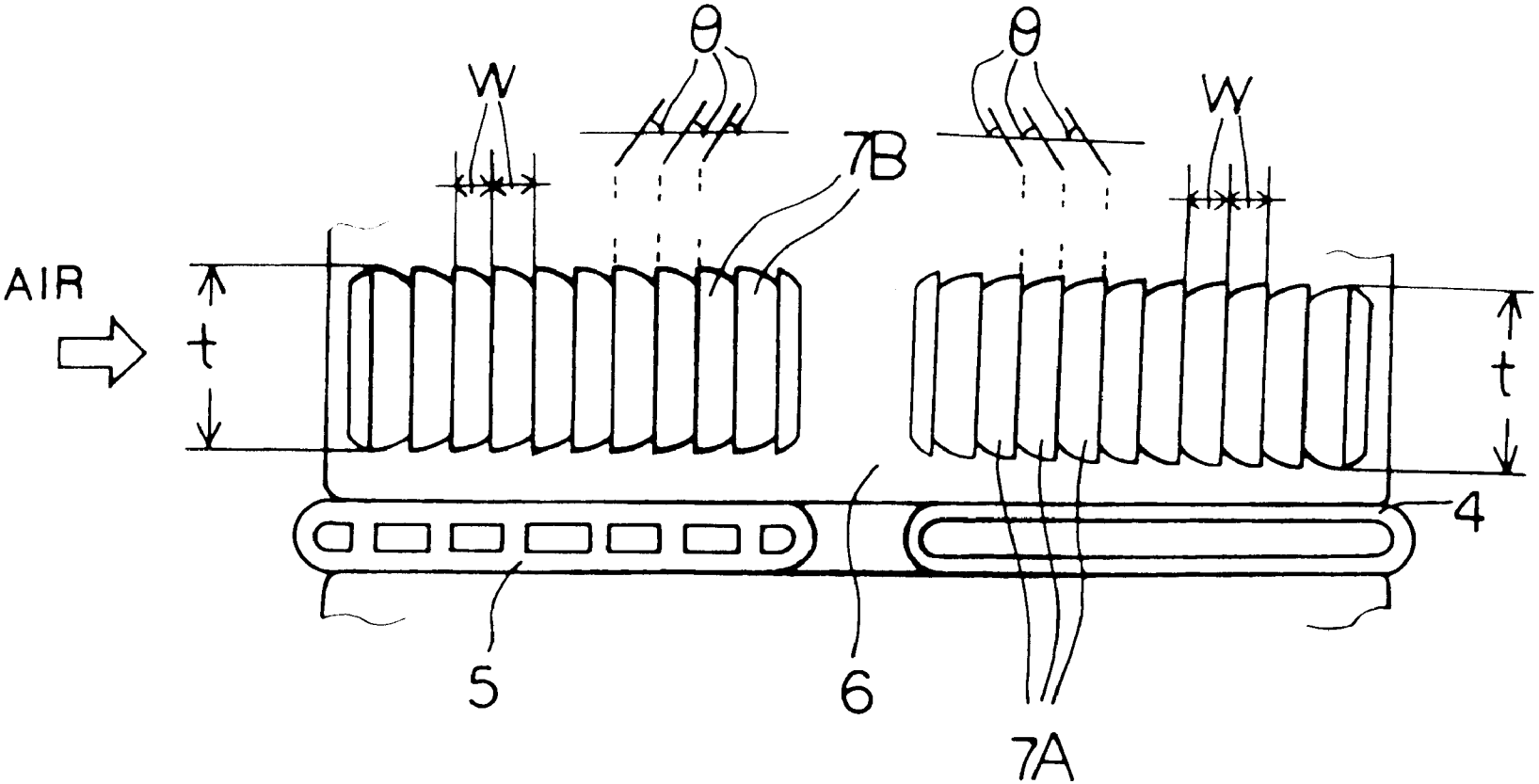
FIG. 16 is a vertical sectional view in part of a fin and a tube for illustrating the opening direction and angle, slit length and width of the louver.

In FIG. 15, a flat portion of the fin 6 connected to the tube 4 for configuring the first heat exchanger A and a flat portion of the fin connected to the tube 5 for configuring the second heat exchanger B have a group of louvers with openings formed toward an opposite direction. In this case, both groups of louvers 7A,7B have the same slit length t, width w, louver angle θ and the number of louver members as shown in FIG. 16, and only openings are formed in opposite directions. The louvers 7A, 7B are formed simultaneously on the flat surface of the fin 6 when the fin 6 is formed to have a corrugated shape.

In this embodiment, the first heat exchanger A is a radiator and the second heat exchanger B is a condenser, which are disposed in parallel in a transverse direction to form the heat exchanger 1.

As described above, by changing the opening direction of the louvers formed on the flat portion of the fin 6 so to direct in an opposite direction on the first heat exchanger A and the second heat exchanger B, the flowing air can be caused to have turbulence or dispersion and also to flow optimally to improve the heat exchange performance. And, the requirements of heat exchange performance of the individual heat exchangers can be also fulfilled. Since the integrally formed fins can be used to improve the respective heat exchange rates and to integrally form a plurality of heat exchangers into one body, the number of parts can be decreased, and the production process can be facilitated. Besides, since the plurality of heat exchangers can be made into one body, a space for its installation is decreased, and it can be made light weighted. An apparatus having the heat exchanger can be made compact, and the number of steps for installation can be also decreased.

Preferred embodiments of the invention will be described with reference to the drawings. It is to be understood that like reference numerals are given to like components through the drawings.

Figure 17:
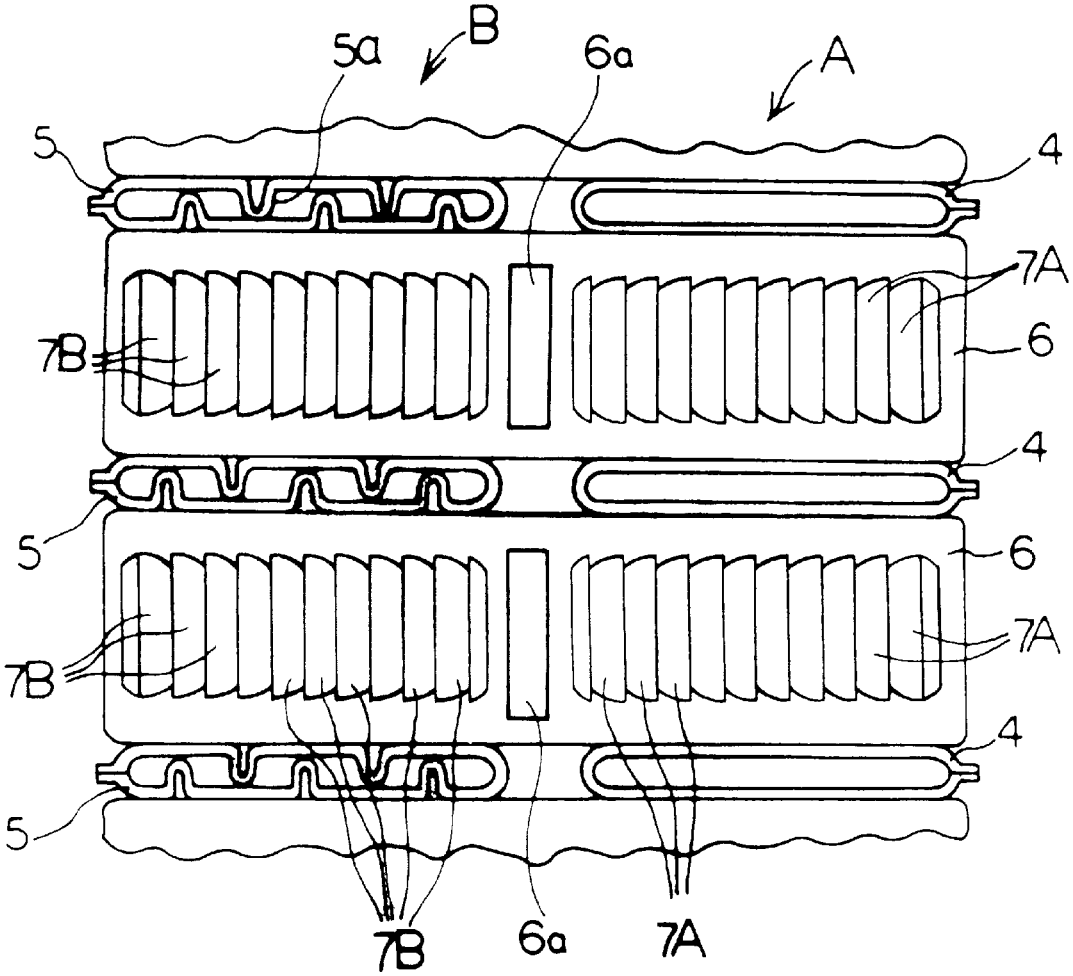
FIG. 17 is a vertical sectional view in part of the fins and tubes according to another embodiment of the invention.

FIG. 17 shows another embodiment of the fins, which have slits 6*a* for preventing heat conduction formed on the fins shown in FIG. 15. By forming the slits 6*a* on the fins 6, the aforementioned effects enabling to meet the heat exchange requirements of the individual heat exchangers can be materialized more specifically.

Figure 18:
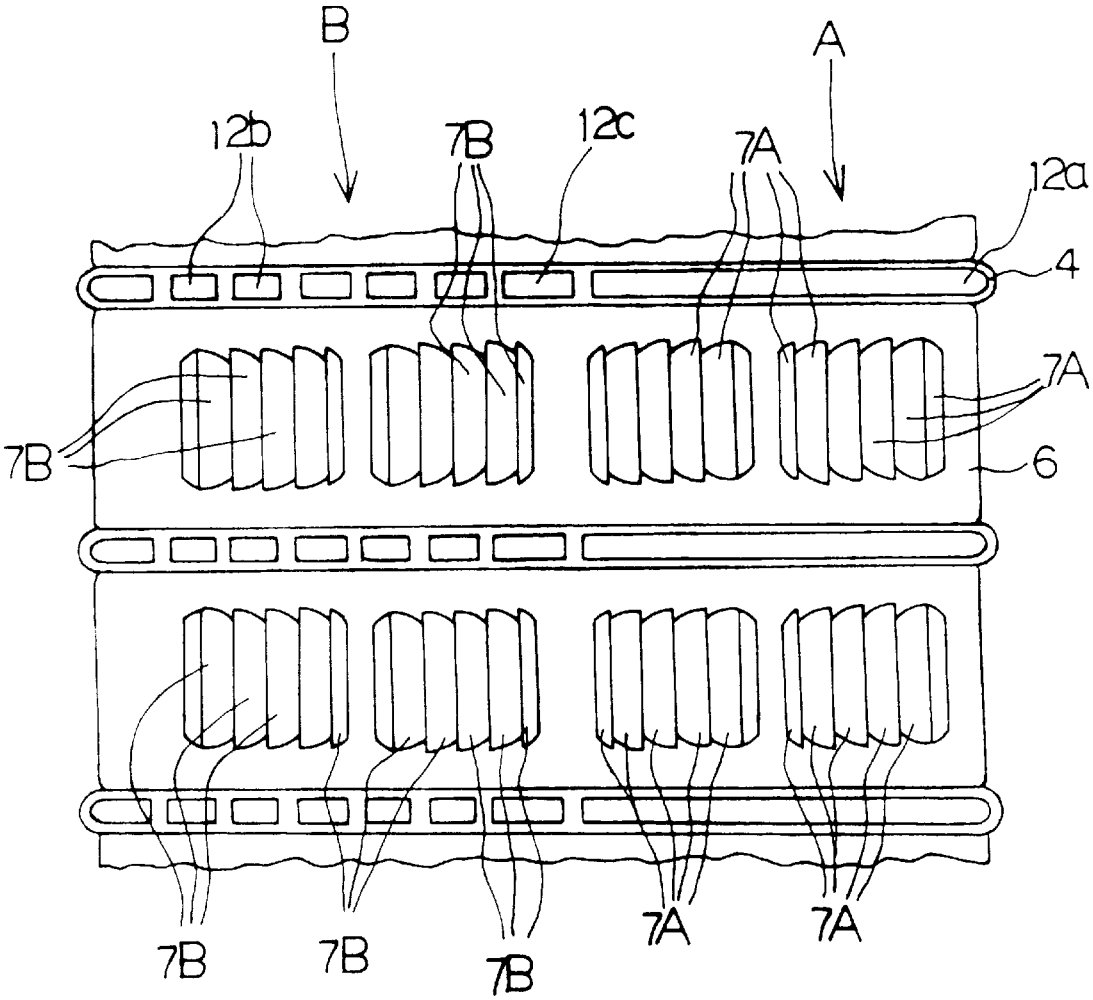
FIG. 18 is a vertical sectional view in part of the fins and tubes according to another embodiment of the invention.
Figure 19:
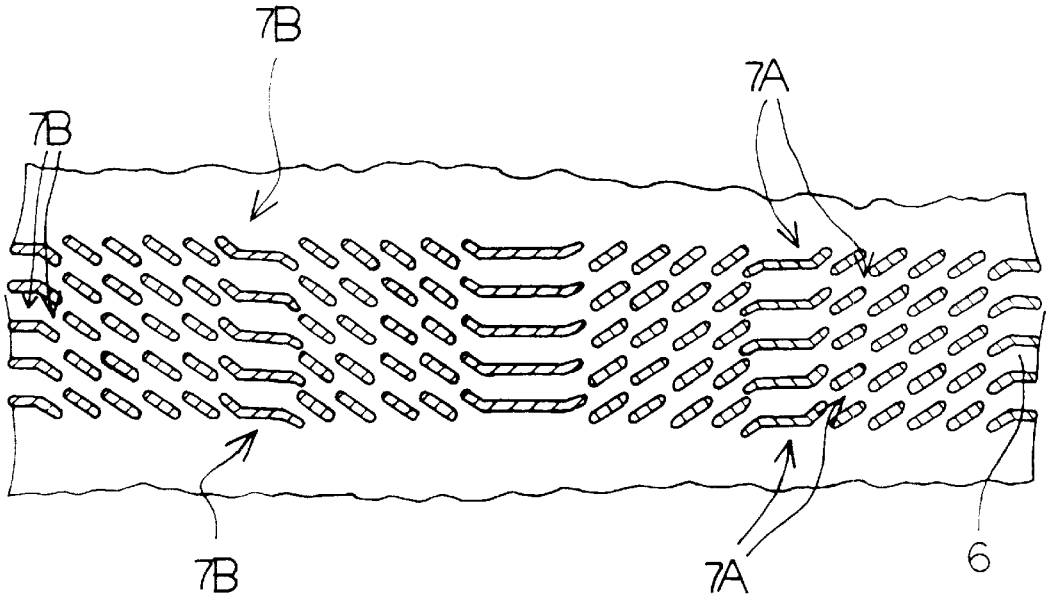
FIG. 19 is a transverse sectional view of the fin shown in FIG. 18.

FIG. 18 and FIG. 19 relate to another embodiment of fins, wherein FIG. 18 is a vertical sectional view in part of fins and tubes and FIG. 19 is a transverse sectional view in part of a fin.

In FIG. 18 and FIG. 19, the fins 6, which are disposed in the first and second heat exchangers A, B, have a plurality of small groups of louvers in each group of louvers formed on the flat portion thereof so to form the louvers 7A, 7B with openings formed toward an opposite direction. These louvers 7A, 7B are formed to have a given pattern, and the louvers 7A, 7B are formed to have each small group of louvers with openings formed toward an opposite direction. In the heat exchanger of this embodiment, the tubes 4 for configuring the first and second heat exchangers A, B are extrusion-molded into one body, 12*a* denotes tube passages to form the first heat exchanger A, and 12*b* denotes tube passages to form the second heat exchanger B. A portion positioned between the first and second heat exchangers A, B has a hollow portion 12*c* formed to prevent heat from being conducted between the first and second heat exchangers A, B.

Thus, the louvers are formed with the direction of the louver's openings formed on the flat portion of the fin 6 changed to an opposite direction for the first heat exchanger A and the second heat exchanger B, thereby causing the flowing air to make turbulence or dispersed as well as to flow optimally. Thus, the heat exchange capacity of the heat exchanger can be improved.

Figure 20:
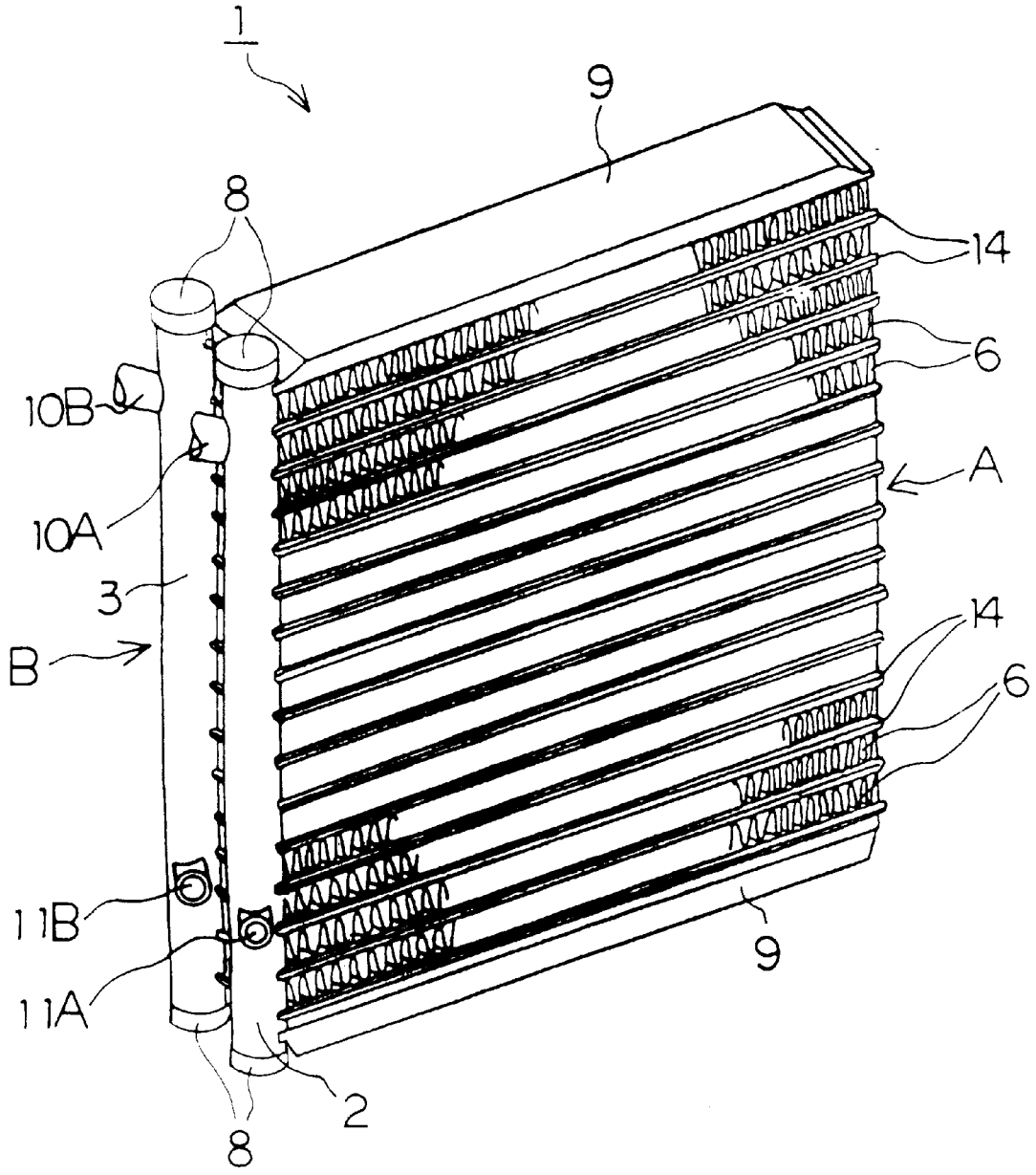
FIG. 20 is a perspective view of the heat exchanger according to another embodiment of the invention.
Figure 21:
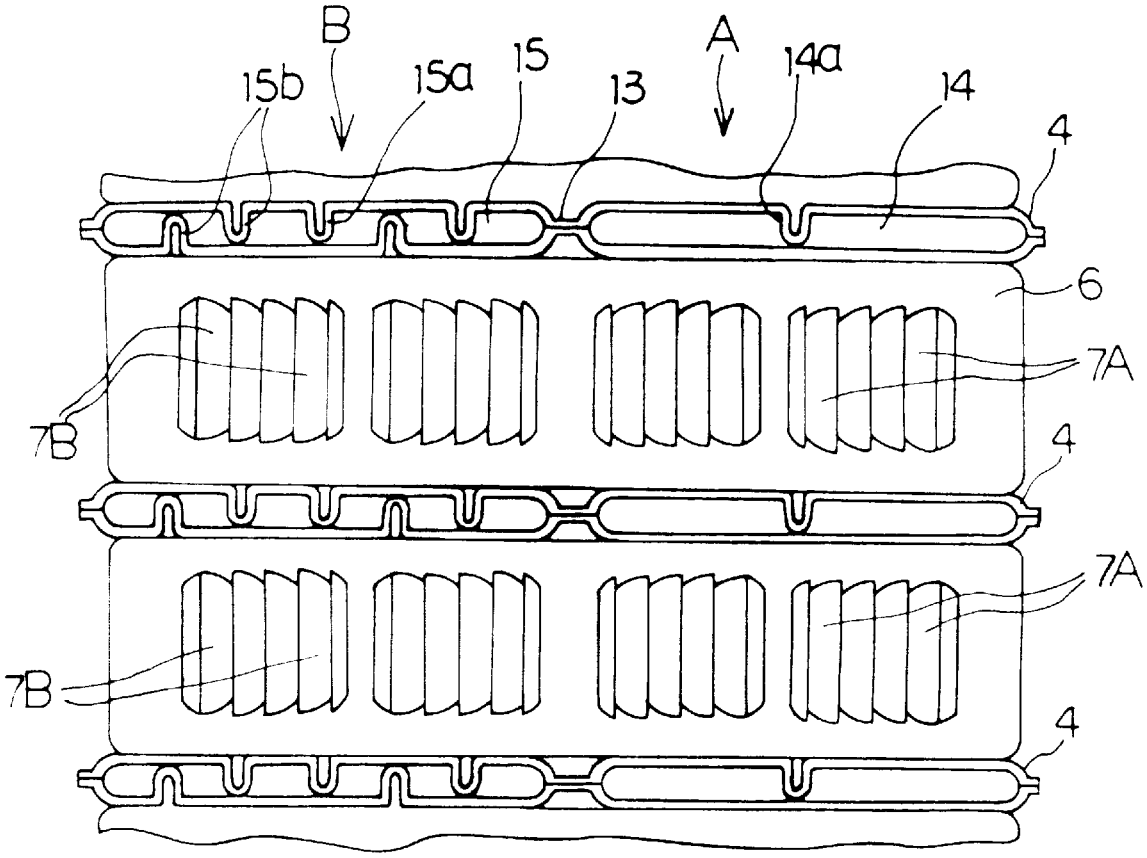
FIG. 21 is a vertical sectional view in part of the fins and tubes according to another embodiment of the invention.
Figure 22:
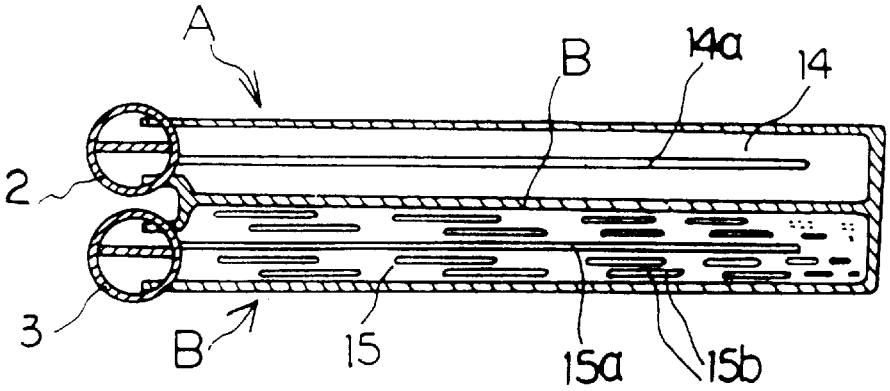
FIG. 22 is a transverse sectional view of the tube having a U-shaped passage according to another embodiment of the invention.

FIG. 20 shows a heat exchanger, which is configured by combining first and second single-tank type heat exchangers. FIG. 21 and FIG. 22 show sectional views in part of tubes and fins of the heat exchanger shown in FIG. 20.

In the drawings, one end of each tube 4 is connected to the tanks 2, 3, the respective tubes 4, 4 have a closed part 13 in a longitudinal direction thereof to divide the passage into two in the longitudinal direction. One passage 14 is connected to the tank 2 to form the first heat exchanger A, and another passage 15 is connected to the tank 3 to form the second heat exchanger B. Thus, the first and second heat exchangers A, B are integrally formed into one body.

Reference numerals 14*a*, 15*b* are ridges, which are in contact with the plate surface, or the ridges 14*a*, 14*a* or 15*a*, 15*a* are mutually contacted to form the respective passages 14, 15 into the U-turn shape. Reference numerals 15*b*, 15*b* are long beads.

Fins 6 disposed in the first and second heat exchangers A, B have louvers 7A, 7B with opening formed toward an opposite direction formed on a portion to be connected to the first heat exchanger A and a portion to be connected to the second heat exchanger B, and the respective louvers 7A, 7B are formed to have a plurality of small groups of louvers. Therefore, air is dispersed and caused to have turbulence as well as to flow optimally, thereby improving the heat exchange performance of the respective heat exchangers.

Figure 23:
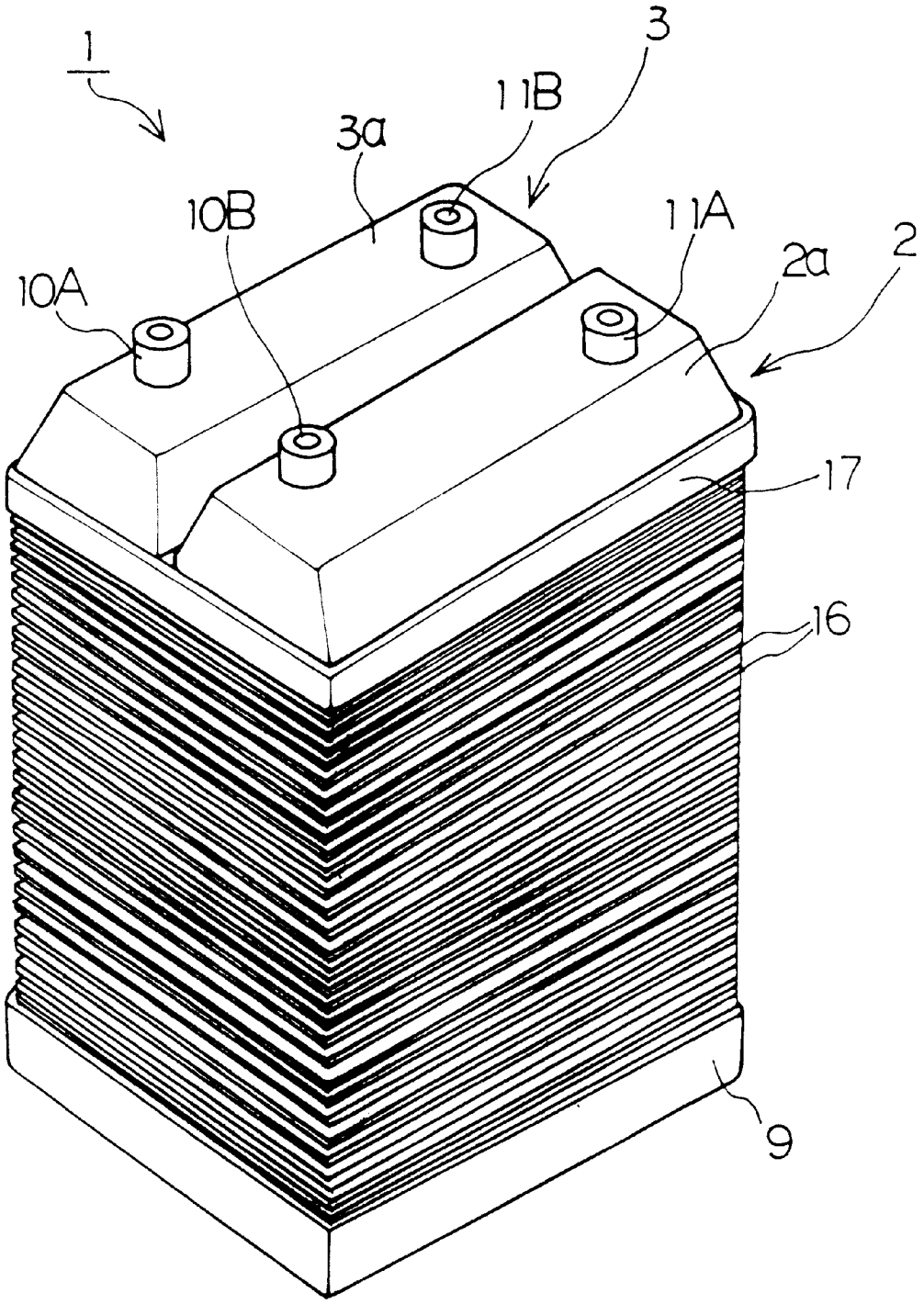
FIG. 23 is a perspective view of the heat exchanger according to another embodiment of the invention.
Figure 24:
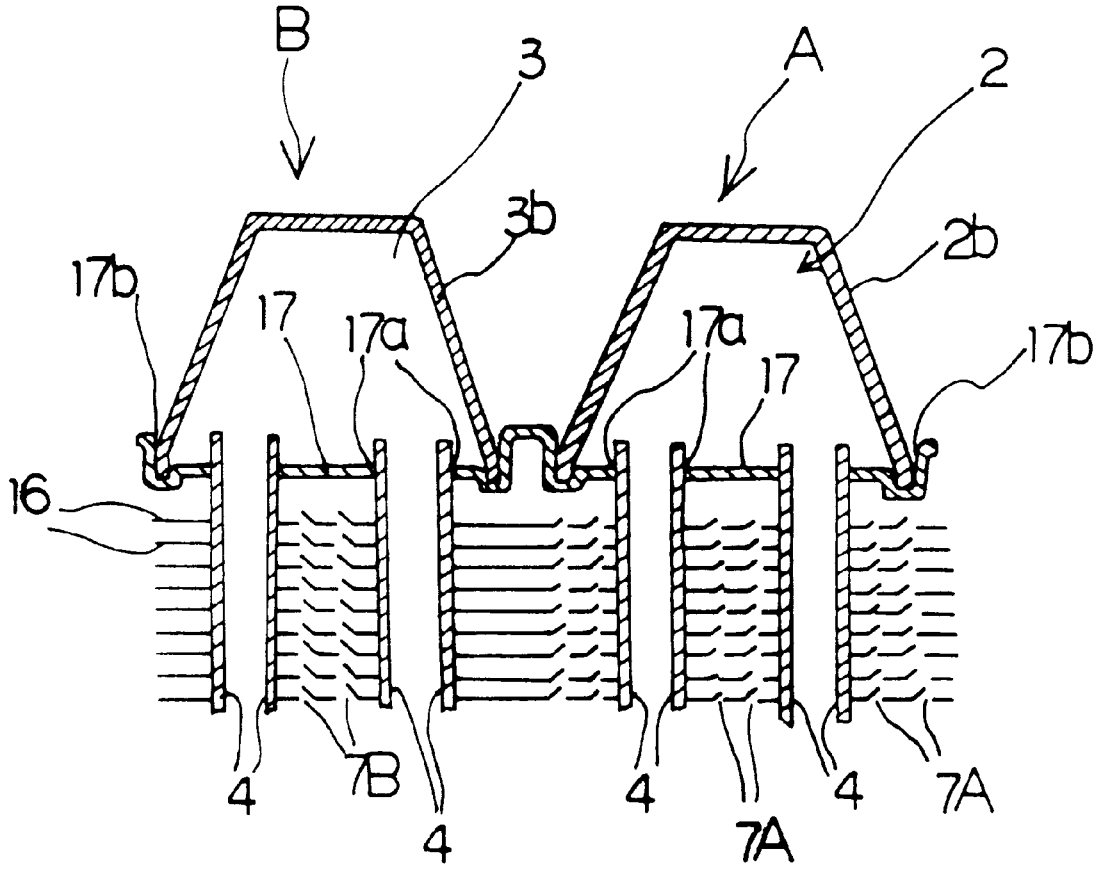
FIG. 24 is a vertical sectional view of tanks in the heat exchanger shown in FIG. 23.

The embodiment shown in FIG. 23 is a heat exchanger with the first and second heat exchangers A, B formed into one body by using plate-type fins 16 stacked. To configure this heat exchanger, tube insertion holes 16*a* are formed through the plate fins 16 (see FIG. 25), a plurality of circular tubes 4, 4 are inserted into the tube insertion holes 16*a*, at least one end of each tube 4 is in contact with a tube insertion hole 17*a* of an end plate 17 as shown in FIG. 24, and a tank plate 2*b* configuring the first heat exchanger A and a tank plate 3*b* configuring the second heat exchanger B are engaged with two rectangular mating grooves 17*b* surrounding the plurality of tubes 4, 4 formed on the end plate. Thus, the first and second heat exchangers A, B are configured into one body. Specifically, the tanks 2, 3 are formed of the end plate 17 and the tank plates 2*b*, 3*b*. And, after brazing the tubes 4, 4, the fins 16, 16 and the end plate 17, the tank plates

2*b*, 3*b* are mounted and joined by caulking using a sealing material (not shown). The inlet joints 10A, 10B and outlet joints 11A, 11B are formed on the tank plates 2*b*, 3*b*, and a side plate 9 is disposed on the opposite side from the tanks 2, 3.

Figure 25:
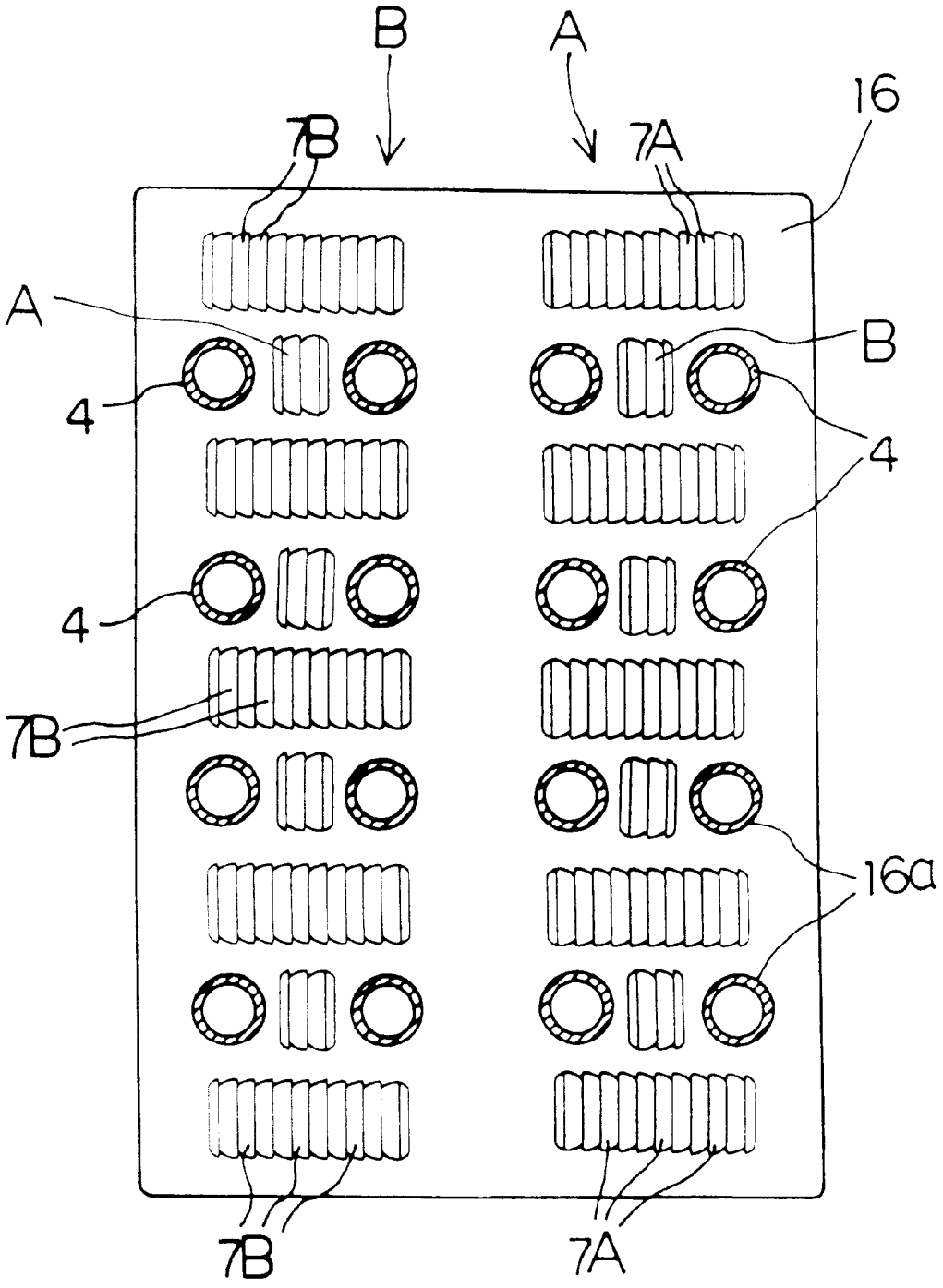
FIG. 25 is a vertical sectional view of fins and tubes of the heat exchanger shown in FIG. 23.

FIG. 25 shows a plate fin used to form the heat exchanger shown in FIG. 23. This plate fin 16 has the louvers 7A, 7B formed around the tube insertion holes 16*a*. The louvers 7A, 7B are formed to have a predetermined pattern. The louvers 7A formed on a part for configuring the first heat exchanger A and the louvers 7B formed on a part for configuring the second heat exchanger B are formed to have openings directed to an opposite direction. Therefore, air flowing through the plate fins 16 is dispersed and caused to make turbulence to effectively improve the heat exchange performance.

Figure 26:
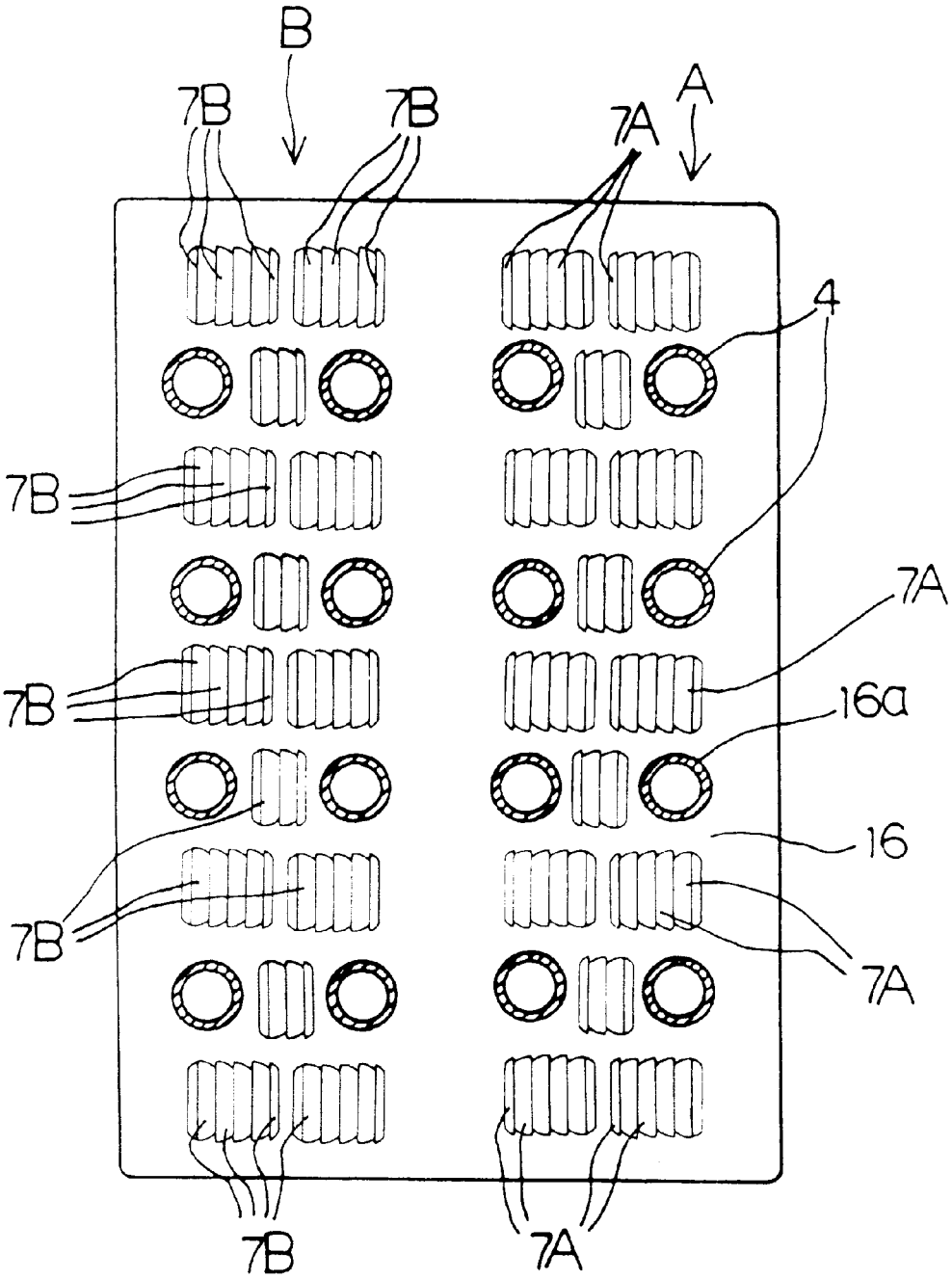
FIG. 26 is a vertical sectional view showing another embodiment of the plate fin.

FIG. 26 shows another example of plate fin. This plate fin 16 has the louvers 7A, 7B formed around the tube insertion holes 16*a*. The louvers 7A, 7B are formed to have a predetermined and plurality of patterns. The louvers 7A formed on a part for configuring the first heat exchanger A and the louvers 7B formed on a part for configuring the second heat exchanger B are formed to have openings formed toward an opposite direction. Therefore, air flowing through the plate fins 16 is dispersed and caused in the same way as described above to make turbulence as well as to flow optimally so to effectively improve the heat exchange performance.

In addition, in the same way, by using the fins with louvers having openings directed in an opposite direction, the heat exchange performance of a laminate type integral heat exchanger having the tank formed with the tubes into one body and of a heat exchanger having a two-split type tank can be improved.

As described above, the heat exchanger of the embodiments described above has the two groups of louvers formed on the fins with the louver openings toward an opposite direction, so that the required performances of the individual heat exchangers can be fulfilled, and the heat exchange rate as a whole can also be improved.

Furthermore, the heat exchanger of the embodiments can be applied to a heat exchanger, which is configured by assembling the tubes and the fins into one body and brazing them in an oven. Basically, the tubes and the fins are integrally assembled and brazed in an oven. In addition to the brazing of the tubes and the fins, any of a tank to be described afterward, tank segments forming the tank and an end plate forming the tank can be also brazed at the same time.

The aforementioned fin structure can be also applied to a heat exchanger, which is formed by integrally assembling the tubes, fins and tanks and brazing them in an oven. In such a case, the tank is formed of a cylindrical body or two split pieces combined into one body and integrally brazed with the tubes and the fins.

And, the above-described embodiment can also be applied to a heat exchanger, which is configured by integrally assembling the tubes, the fins and the tank segments stacked for forming the tank and brazing in an oven. In this case, the above-described laminate type having the tank segments integrally formed with the tubes is integrally brazed.

The fin structure of this embodiment can also be applied to a heat exchanger, which is configured by brazing tubes, fins and end plates in an oven and bonded with tanks. In this case, after brazing the tubes and the fins in the oven, a sealing material is used to bond with tanks by caulking or the like. This heat exchanger is not required to have a very high-pressure resistance.

The fin structure can be also applied to a heat exchanger, which is formed with a U-turn shape passage formed in the tubes. Such a heat exchanger is a single-tank type, which is formed by bonding the ends of the tubes on the other side of the U-turn shape passage connected to the tank. The fin structure of this embodiment can also be applied to this single tank type.

INDUSTRIAL APPLICABILITY

The invention is applied to a heat exchanger for automobiles and household electric appliances, and more particularly used as a heat exchanger, which has a radiator and a condenser formed into one body, for automobiles.

What is claimed is:

1. A heat exchanger comprising:

a plurality of first tubes for configuring a first heat exchanger, a plurality of second tubes for configuring a second heat exchanger, the plurality of first and second tubes being juxtaposed parallel with each other and the plurality of the first tubes being disposed downstream and the plurality of the second tubes being disposed upstream with respect to a direction of air's flow, ends of the plurality of the first tubes being connected into a first pair of tanks and ends of the plurality of the second tubes being connected into a second pair of tanks, and a plurality of common fins integrally formed and stacked and extending between the plurality of the first and second tubes, wherein each of the fins has a plurality of louvers, which are divided into a first group of louvers formed on a part of the fin disposed in the first heat exchanger and a second group of louvers formed on a part of the fin disposed in the second heat exchanger, the two groups of louvers of fins being different in all of parameters including angle, number and width of louvers, and the fins and first and second tubes are integrally assembled and then brazed in an oven.

2. The heat exchanger according to claim 1, wherein the two groups of louvers of the fins have a different opening direction.

3. The heat exchanger according to claim 1, wherein the two groups of louvers of the fins have a different slit length.

* * * * *